US005267180A

United States Patent [19]

Okayama

[11] Patent Number: 5,267,180

[45] Date of Patent: Nov. 30, 1993

[54] FIRE ALARM SYSTEM HAVING PRESTORED FIRE LIKELIHOOD RATIO FUNCTIONS FOR RESPECTIVE FIRE RELATED PHENOMENA

[75] Inventor: Yoshiaki Okayama, Tokyo, Japan

[73] Assignee: Nohmi Bosai Kabushiki Kaisha, Tokyo, Japan

[21] Appl. No.: 571,649

[22] PCT Filed: Jan. 24, 1990

[86] PCT No.: PCT/JP90/00079

§ 371 Date: Aug. 30, 1990

§ 102(e) Date: Aug. 30, 1990

[87] PCT Pub. No.: WO90/09012

PCT Pub. Date: Aug. 9, 1990

[30] Foreign Application Priority Data

Jan. 25, 1989 [JP] Japan ..... 1-14133
Jan. 25, 1989 [JP] Japan ..... 1-14134
Jan. 25, 1989 [JP] Japan ..... 1-14135

[51] Int. Cl.[5] ..... G08B 17/00

[52] U.S. Cl. ..... 364/571.03; 364/550; 340/825.36; 340/589; 395/900

[58] Field of Search ..... 364/550, 551.01, 556, 364/581, 555, 557, 571.01, 571.03, 571.05; 340/577, 584, 587, 628, 825.06, 825.36, 578, 579, 588, 589; 395/900

[56] References Cited

U.S. PATENT DOCUMENTS 4,507,652 3/1985 Vogt et al. ..... 340/825.36 X
4,644,331 2/1987 Matsushita et al. ..... 340/587
4,644,478 2/1987 Stephens et al. ..... 364/550
4,803,469 2/1989 Matsushita ..... 340/557
4,871,999 10/1989 Ishii et al. ..... 340/587
4,884,222 11/1989 Nagashima et al. ..... 364/550
4,926,364 5/1990 Brotherton ..... 364/581
4,975,684 12/1990 Guttinger et al. ..... 340/587

FOREIGN PATENT DOCUMENTS 0036276 9/1981 European Pat. Off. ..... 340/577
2190777 11/1987 United Kingdom .

*Primary Examiner*—Jack B. Harvey
*Assistant Examiner*—Edward J. Pipala
*Attorney, Agent, or Firm*—Wenderoth, Lind & Ponack

[57] ABSTRACT

A fire alarm system discriminates the presence of a fire using plural likelihood ratio functions respectively associated with plural fire related phenomenon. At least one fire related condition, for example, a temperature level, a smoke density or a gas concentration, of a detected area is detected. Data denoting plural fire related phenomenon are generated based on the at least one fire related condition. The data of each fire related phenomenon is applied to a respective likelihood ratio function defining a relation between the value of the fire related phenomenon and the value of a fire likelihood ratio. The fire likelihood ratio defines a relative probability of a fire attributable to the value of the respective fire related phenomenon. Plural fire likelihood ratio values are obtained according to processing rules, and a centroid value is obtained based on the plural fire likelihood ratio values. A fire is discriminated based on the centroid value.

18 Claims, 15 Drawing Sheets

FIRE ALARM SYSTEM HAVING PRESTORED FIRE LIKELIHOOD RATIO FUNCTIONS FOR RESPECTIVE FIRE RELATED PHENOMENA

TECHNICAL FIELD

The present invention relates to a fire alarm system for obtaining at least one piece of fire information such as a fire likelihood ratio, degree or level of danger on the basis of detected information or data related to physical quantities of fire phenomena such as smoke, heat, gases and others and/or environmental data such as the size of room, the number of occupants, ambient temperature and others.

BACKGROUND TECHNOLOGY

There are a variety of methods known for detecting the occurrence of fires. By way of example, one of the simplest methods entails discriminating the occurrence of a fire on the basis of a sensor level, i.e. detection data of a fire detector, wherein a fire signal is output when the sensor level exceeds a certain predetermined level. In this case, although the fire signal is output from the fire detector depending on whether or not the detection signal exceeds the predetermined level, various environmental conditions are not fully taken into account. In this connection, it is conceivable that the environmental information may be collected in addition to the detected information from the fire detector, wherein the fire discrimination is synthetically made on the basis of both the detection information and the environmental information. However, the environmental conditions are intrinsically ambiguous and consideration thereof in the fire discrimination can not always assure a sufficiently high reliability of a correct generation of the fire signal. In actuality, there frequently arise situations in which a phenomenon other than a fire triggers generation of a fire signal.

SUMMARY OF THE INVENTION

Accordingly, it is an object of the present invention to ensure a highly improved accuracy in making the fire decision by processing the collected information or data inclusive of the environmental data by a method which can assure a higher reliability than the methods known heretofore.

In view of the above object, there is provided according to a first mode for carrying out the invention a fire alarm system for obtaining the fire information on the basis of various data concerning fire phenomena, characterized in that the system comprises data acquisition means (steps 305, 306, 310, 312) for acquiring various data to be collected concerning the fire phenomena and data to be processed from the collected data, definition means (ROM14, ROM15) for defining functions for the fire information for each piece of data obtained through the data acquisition means and at least one rule for processing to be performed by using the abovementioned function, and processing means (steps 314, 316, 318) for obtaining the fire information by processing the data obtained through the data acquisition means on the basis of the abovementioned processing rules and the corresponding functions employed in the processing rules to thereby obtain a function value for each of the processings and by determining a centroid of the function values thus obtained (step 326).

The information or data related to the fire phenomena and obtained through the data acquisition means includes not only the detection information of the physical quantities intrinsic to a fire phenomenon but also various environmental information or data such as the size of a room, the ambient temperature and others which exert influences on the detection information as well as so-called processed information such as changes in detection information as a function of time, integrated values thereof and the like.

The definition means which may be constituted, for example, by storage means which defines and stores therein the functions concerning the acquired data vis-a-vis fire information for every piece of data obtained by the data acquisition means in the form of formulae, tables or the like and additionally at least one (usually a plurality of) processing rule as to which of the acquired pieces of data vis-a-vis fire information function (one or more functions) is to be adopted in the data processing.

On the other hand, the processing means is adapted to process the data obtained by the data acquisition means in accordance with the plurality of processing rules defined on the basis of the corresponding functions to be used in the processing rules to thereby obtain the function values for every processing rule and determine the centroid of the function values, for example, by averaging the obtained function values. In this way, fire information such as the fire likelihood ratio, the danger level and the like can be obtained.

In the fire alarm system which comprises a receiving part such as a fire receiver, a repeater or the like and a plurality of fire detectors each including at least one fire phenomenon detecting means for detecting a physical quantity attributable to the fire phenomenon, the definition means and the processing means may be provided either at the receiving part so that the fire decision can be carried out at the receiving part on the basis of the data collected from the fire detectors, or alternatively the definition means and the processing means may be provided at the fire detector so that the fire decision can be made at the fire detector with only the results of the decision being sent to the receiving part.

In this manner, by properly selecting processing rules appropriate to the environmental conditions and previously defining the rules by the definition means, it is possible to take into consideration a great variety of acquired data inclusive of the environmental information or data exerting influence on the detected data of the fire phenomenon and other data having contribution to the fire information to be obtained. Since the processing means processes the acquired data for every processing rule defined in conformance with the environmental conditions and determines the centroid of the fire information thus obtained, it is possible to appropriately narrow down the wide range of acquired data, whereby highly reliable fire information can be obtained.

In accordance with a second mode for carrying out the present invention, there is provided a fire alarm system for obtaining fire information on the basis of various pieces of data concerning the fire phenomena, which system is characterized in that it comprises:

data acquisition means (steps 706, 712, 714, 716, 718, 720, 722, 724) for acquiring various data to be collected concerning the fire phenomena and data to be processed from the collected data;

definition means (ROM33, ROM34) for defining functions for the fire information for each piece of data obtained through the data acquisition means at least one rule for processing to be performed by using the abovementioned function;

selection control means (ROM32, steps 726, 728) for selecting one or more rules from the abovementioned processing rules defined by the definition means in accordance with the environmental condition determined by the data obtained through the data acquisition means; and selective rule processing means for processing the data obtained through the data acquisition means in accordance with each of the abovementioned rules selected by the selection control means on the basis of the corresponding function defined by the definition means to thereby obtain a function value for each of the selected processing rules (steps 730 to 738) and determine a centroid of the function values obtained (steps 740, 742).

The data acquisition means obtains information or data similar to that obtained by the data acquisition means in the first mode for carrying out the invention, while the definition means defines the functions for the acquired data vis-a-vis fire information and a plurality of the processing rules as in the case of the definition means mentioned above in conjunction with the first working mode of the invention.

The selective control means first determines on the basis of the data obtained through the data acquisition means the environmental condition(s) of a place for which the fire information is to be obtained and then selects one or more processing rules defined in the definition means in accordance with the determined environmental condition(s).

Finally, the selective rule processing means processes the data obtained through the data acquisition means in accordance with each of the rules selected by the selection control means on the basis of the corresponding function defined by the definition means to thereby obtain a function value for each of the selected processing rules and determine a centroid of the function values by averaging or through a similar procedure.

In this manner, the second working mode of the invention is profitably developed from the first working mode so that the processing rules are discriminated in respect to the effectiveness in use in light of the environmental conditions, wherein only the effective processing rules are adopted.

Further, according to a third mode for carrying out the invention, there is provided a fire alarm system for obtaining fire information on the basis of the various data concerning fire phenomena, which system is characterized in that it comprises:

data acquisition means (FS, $SI_1$, $SI_2$, CL3, ROM46 and steps 906, 912, 916, 918, 920, 922, 924, 926) for acquiring various pieces of data to be collected concerning the fire phenomena and data to be processed from the collected data;

definition means (ROM43, ROM44) for defining a function for the fire information for each piece of data obtained through the data acquisition means and at least one rule for processing to be performed by using the abovementioned function;

weighting control means (ROM42, ROM45 and steps 928) for imparting a weight to each of the abovementioned processing rules defined by the definition means in accordance with environmental conditions determined from the data obtained through the data acquisition means; and weighted rule processing means for processing the data obtained through the data acquisition means in accordance with each of the processing rules imparted with the weights by the weighting control means by using the corresponding function defined by the definition means to thereby obtain a weighted function value for each of the processing rules (steps 930 to 944) and determining a centroid of the function values obtained (step 946).

The data acquisition means obtains data or information similar to that obtained by the data acquisition means in the first and second working modes of the invention, and the definition means defines the functions for the acquired data vis-a-vis fire information and a plurality of processing rules.

The weighting control means first determines on the basis of the data obtained through the data acquisition means the environmental condition(s) of a place for which the fire information is to be obtained and imparts weights to the individual processing rules defined in the definition means in accordance with the determined environmental conditions.

Finally, the weighted rule processing means processes the data obtained through the data acquisition means in accordance with each of the processing rules imparted with the weights by the weighting control means by using the corresponding function defined in the definition means to thereby obtain a weighted function value for each of the processing rules and determines a centroid of the function values obtained by averaging or a like.

As is apparent from the above, the third working mode of the invention is profitably developed from the first and second working modes of the invention so that the individual processing rules are imparted with weights in such a manner that higher weights are applied to more effective rules in accordance with the environmental conditions.

DETAILED DESCRIPTION OF THE PREFERRED EMBODIMENTS

In the following, the present invention will be described in conjunction with a first exemplary embodiment thereof.

Figure 1:
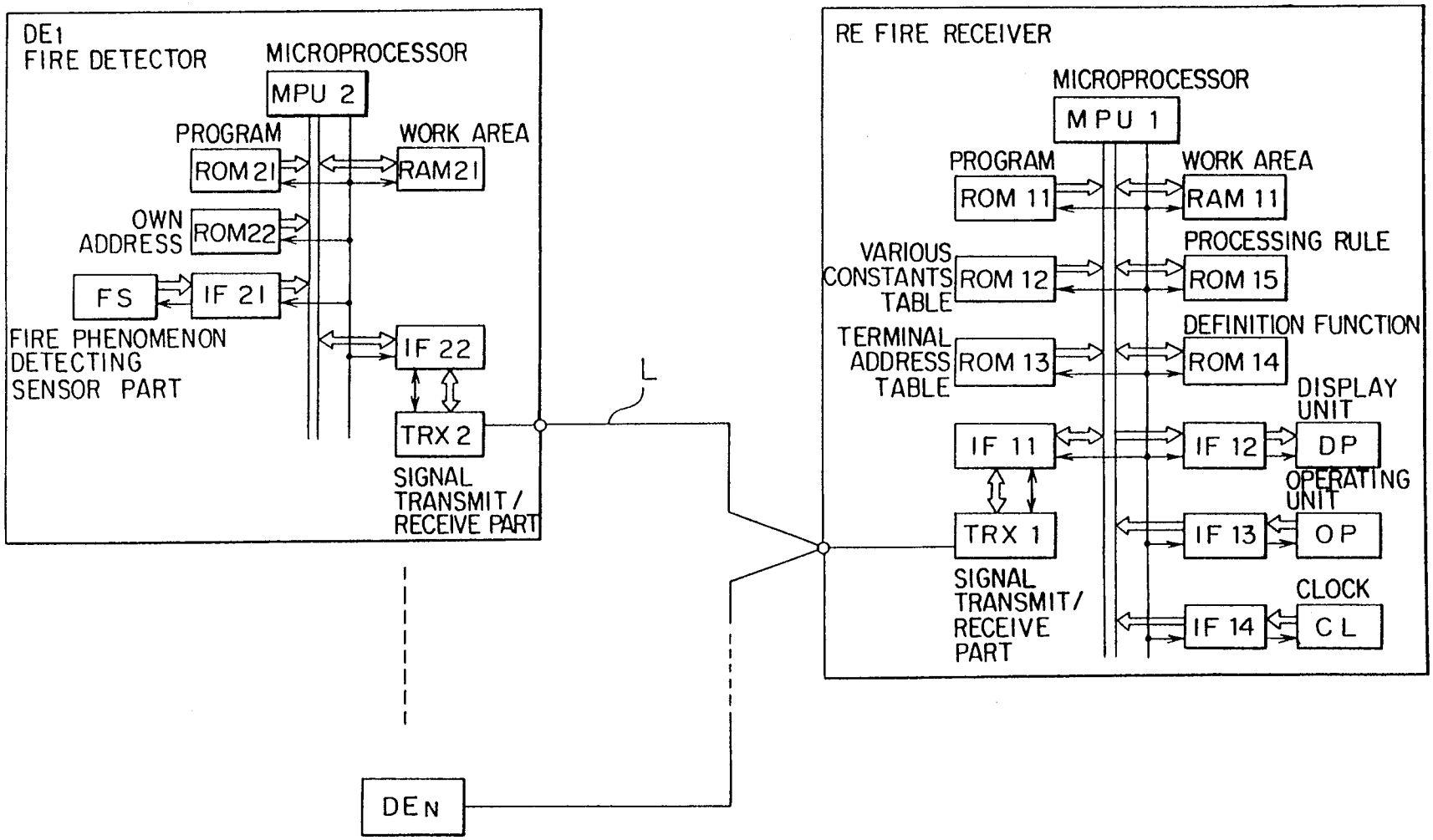
FIG. 1 is a block circuit diagram showing a fire alarm system to which a first embodiment of the present invention is applied.
Figure 2A:
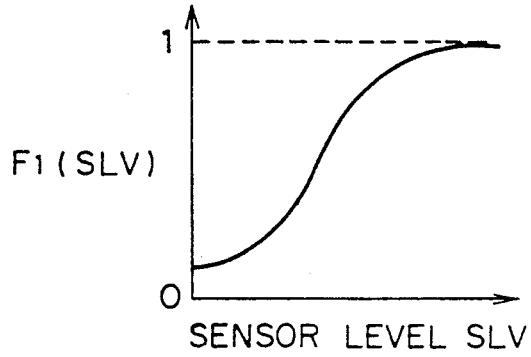
FIGS. 2(*a*)–2(*e*) show examples of definition functions which can be employed according to the first embodiment.
Figure 2D:
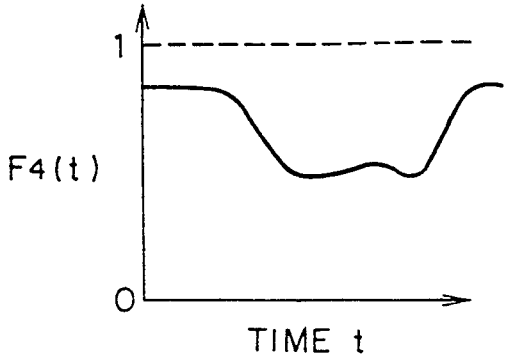
Figure 2B:
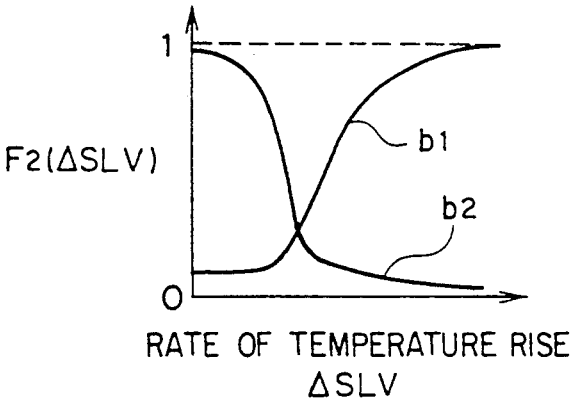
Figure 2E:
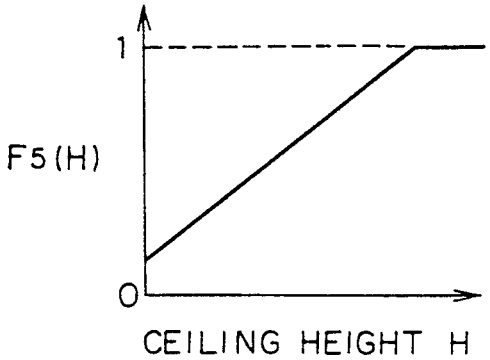
Figure 2C:
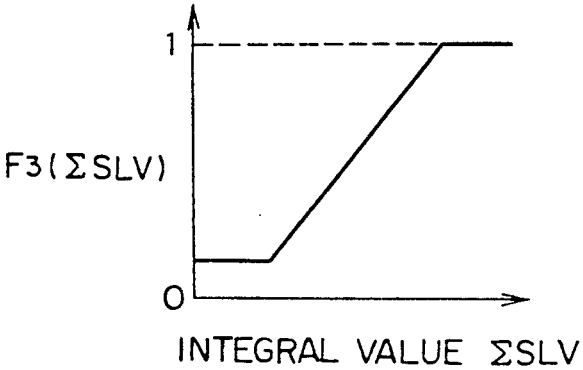

FIG. 1 is a block circuit diagram showing a so-called analogue type fire alarm system to which the present invention is applied and in which sensor levels representative of analogue physical quantities originating in the fire phenomena detected by individual fire detectors are sent to a receiving part such as a fire receiver RE, a repeater or the like, wherein the receiving part is adapted to make a decision as to the occurrence of a fire on the basis of the sensor levels as collected. It goes without saying that the present invention can equally be applied to an on/off type fire alarm system in which the decision as to the occurrence of a fire is made at the individual fire detectors, wherein only the results of such decisions are sent to the receiving part.

In FIG. 1, a reference character RE denotes a fire receiver, and $DE_1$ to $DE_N$ denote N analogue type fire detectors connected to the fire receiver RE by way of a transmission line L which may be constituted, for example, by a pair of lines serving for both electric power supply and signal transmission, in which only one of the fire detectors, $DE_1$ is illustrated in detail with respect to the internal circuit configuration thereof.

In the fire receiver RE:

MPU1 denotes a microprocessor;

ROM11 denotes a program storage area for storing programs relevant to the operation of the inventive system which will be described hereinafter;

ROM12 denotes a storage area for storing a table of various constants;

ROM13 denotes a terminal address table storage area;

ROM14 denotes a definition function storage area for storing various definition functions such as definition functions for the sensor level SLV, definition functions for integrated values, temporal or time-related definition functions and others;

ROM15 denotes a storage area for storing processing rules for every fire detector;

RAM11 denotes a work area;

DP denotes a display unit such as a CRT or the like;

OP denotes an operating or manipulating unit;

CL denotes a clock;

TRX1 denotes a signal transmission/reception part composed of a serial-to-parallel converter, a parallel-to-serial converter and others; and

IF11 to IF14 denote interfaces, respectively.

Further, in connection with the fire detector $DE_1$:

MPU2 denotes a microprocessor;

ROM21 denotes a program storage area;

ROM22 denotes an own address storage area;

RAM21 denotes a work area; and

FS denotes a fire phemonenon detecting sensor part for detecting one of the physical quantities such as heat, smoke, gases or the like attributable to the fire phenomena, wherein the sensor part is composed of an amplifier, a sample and hold circuit, an analogue-to-digital converter and others, although they are not shown. Further,

TRX2 denotes a signal transmission/reception part similar to TRX1, and

IF21 and IF22 denote interfaces, respectively.

Stored in the definition function storage area ROM14 incorporated in the fire receiver RE are a variety of definition functions such as those illustrated in FIGS. 2(*a*) to (*e*), by way of example, in the form of formulae or tables. In the case of the examples illustrated in FIGS. 2(*a*) to (*e*), fire likelihood ratios are shown as the fire information (taken along the ordinates) for the various acquired information or input data (taken along the abscissas). More specifically, there is shown in FIG. 2(*a*) a definition function $F_1(SLV)$ of the fire likelihood ratio in a range of 0 to 1 for the sensor level SLV supplied as the input data from the fire phenomenon detecting sensor part FS. In FIG. 2(*b*), there is shown a definition function $F_2(\Delta SLV)$ of the fire likelihood ratio in a range of 0 to 1 for the rate of change in temperature $\Delta SLV$ or the rate of temperature rise supplied as the input data from the sensor part FS on the assumption that the latter is a sensor for detecting temperature. (In this figure, a curve $b_1$ represents the likelihood ratio of a blazing fire while a curve $b_2$ represents the likelihood ratio of a smoldering fire. In this conjunction, the term "fire" is intended to mean fire phenomena inclusive of the smoldering fire while "smoldering fire" refers to the state in which only smoke is produced without accompanying flame.) In FIG. 2(*c*), there is shown a definition function $F_3(\Sigma SLV)$ of the fire likelihood ratio in a range of 0 to 1 for an integrated value $\Sigma SLV$ of the sensor level. In FIG. 2(*d*), there is shown a definition function $F_4(t)$ of the fire likelihood ratio in a range of 0 to 1 for the time t as the environmental information or data on the presumption that changes in the environmental condition influence the fire decision value. In FIG. 2(*e*), there is shown a definition function of the fire likelihood ratio in a range of 0 to 1 for the height (H) of the ceiling exemplifying one piece of environmental information or data. Other various definition functions may be stored in the storage area ROM14 so as to be read out therefrom for utilization, as occasion requires.

The processing rule storing area ROM15 stores therein the rules for the processings to be performed for every fire detector. The term processing rules means the definitions of relations between one or more species of the acquired data as input and the output information to be derived therefrom. As an example of the definition of the relation between one species of the acquired data and the output information to be derived or obtained, there may be mentioned as one of the processing rules (i) A relation interlinking the sensor level SLV with the fire likelihood ratio and illustrated by the expression "If the smoke sensor level SLV is equal to X, then the fire likelihood ratio is $F_1(X)$" is a processing rule. In the case of the instant embodiment of the invention, this rule can be represented by the definition function of the fire likelihood ratio $F_1(SLV)$ for the sensor level SLV which can be determined with the aid of the graph shown in FIG. 2(*a*);

(ii) Another rule can be established such that if the rate of temperature rise ΔSLV is equal to Y, then the fire likelihood ratio is $F_2(Y)$. This can be determined by using the definition function illustrated in FIG. 2(*b*) in the case of the instant embodiment;

(iii) Similarly, a rule to the effect that "If the integrated value ΣSLV is equal to Z, then the fire likelihood ratio is $F_3(Z)$" can be defined by using the definition function illustrated in FIG. 2(*c*) in the case of the instant embodiment;

(iv) A rule to the effect that "If the time t is equal to T, then the fire likelihood ratio is $F_4(T)$" can also be determined on the basis of the definition function illustrated in FIG. 2(*d*) in the case of the instant embodiment;

(v) Further, a rule to the effect that "If the ceiling height is H, the fire likelihood ratio is $F_5(H)$" can also be determined by using the definition function shown in FIG. 2(*e*). Of course, other rules can equally be adopted, if desired.

As examples of the definition for the relations between two or more species of the acquired data input and the output information, there can be mentioned (vi) Such a definition of the relation existing between the ceiling height H of a room and the smoke sensor level as exemplified by "When smoke is detected in a room having a high ceiling, the fire likelihood ratio is high". In this case, the corresponding rule will read; "If the sensor level SLV is equal to X and if the ceiling height is equal to H, then the fire likelihood ratio is $F_6$". For determining the result of the decision according to this composite rule, the result $F_1(X)$ of the rule reading; "If the sensor level SLV is equal to X, the fire likelihood ratio is $F_1(X)$" and the result $F_5(H)$ of the rule reading; "If the ceiling height is equal to H, then the fire likelihood ratio is $F_5(H)$" are determined individually by consulting the defined relations shown in FIGS. 2(*a*) and (*e*), respectively, whereon either one of $F_1(X)$ or $F_5(H)$ which has a smaller value is determined as the output information $F_6$ of this two-conditional rule;

(vii) As another example, there may be mentioned such a composite rule to the effect that "If the sensor level SLV is equal to X and if the time t is equal to T, then the fire likelihood ratio is $F_7$". This rule may be adopted, for example, in such a case where the fire likelihood ratio differs between daytime and night even when the sensor level SLV as detected is of the same value. For deriving a conclusion from this rule, the result $F_1(X)$ of the rule that "If sensor level SLV is equal to X, then the fire likelihood ratio is $F_1(X)$" and the result $F_4(T)$ of the rule that "If t is equal to T, then the fire likelihood ratio is $F_4(T)$" are determined individually by consulting the relations shown in FIGS. 2(*a*) and (*d*), respectively, whereon either $F_1(X)$ or $F_4(T)$ of a smaller value is determined as the output information $F_7$ of this two-conditional rule.

One or more of the processing rules mentioned above are defined for each of the fire detectors and they are stored in the respective fire detector areas in the storage area ROM15. By way of example, when the rules (i), (iii) and (vii) mentioned above are to be used in connection with the first fire detector $DE_1$, the rules (i), (iii) and (vii) are stored in the area allocated to the first fire detector $DE_1$ in the storage are ROM15. On the basis of these rules, a program stored in the storage area ROM11 as described hereinafter is executed for deriving the output information $F_1(X)$, $F_3(Z)$ and $F_7$ for the rules, respectively, with the aid of the definition functions shown in FIG. 2 and stored in the storage area ROM14, whereon the centroid of the results is determined. As the operation for determining the centroid, a sum of the values of the definition functions obtained for the abovementioned rules, respectively, may be divided by the number of the rules to thereby obtain the mean value of the definition function values in the case of the instant embodiment, as follows:

$$F=[F_1(X)+F_3(Z)+F_7]/3$$

The mean value F of the definition functions thus determined represents the desired fire information, i.e. the fire likelihood ratio in the case of the instant embodiment.

In this manner, on the basis of the definition functions stored in the storage area ROM14 and representing the relations between the input values of the numerous environmental data and the fire likelihood ratios and the processing rules stored in the storage are ROM15, an inference can be developed with the aid of the program stored in the storage area ROM11.

Since the contents of the individual definition functions and the rules can be determined accurately by experiments and theoretical analysis, the values of the definition functions, i.e. those of the fire likelihood ratios determined as the outputs of the rules are highly reliable. Further, since the final result is derived by averaging the sum resulting from the addition of the outputs of the various rules, a numerical value capable of indicating the fire likelihood ratio with a high reliability may be obtained.

Parenthetically, the storage areas ROM14 and ROM15 should preferably be rewritable or exchangeable, if necessary, as in the case where a change in environmental conditions requires it.

Figure 3:
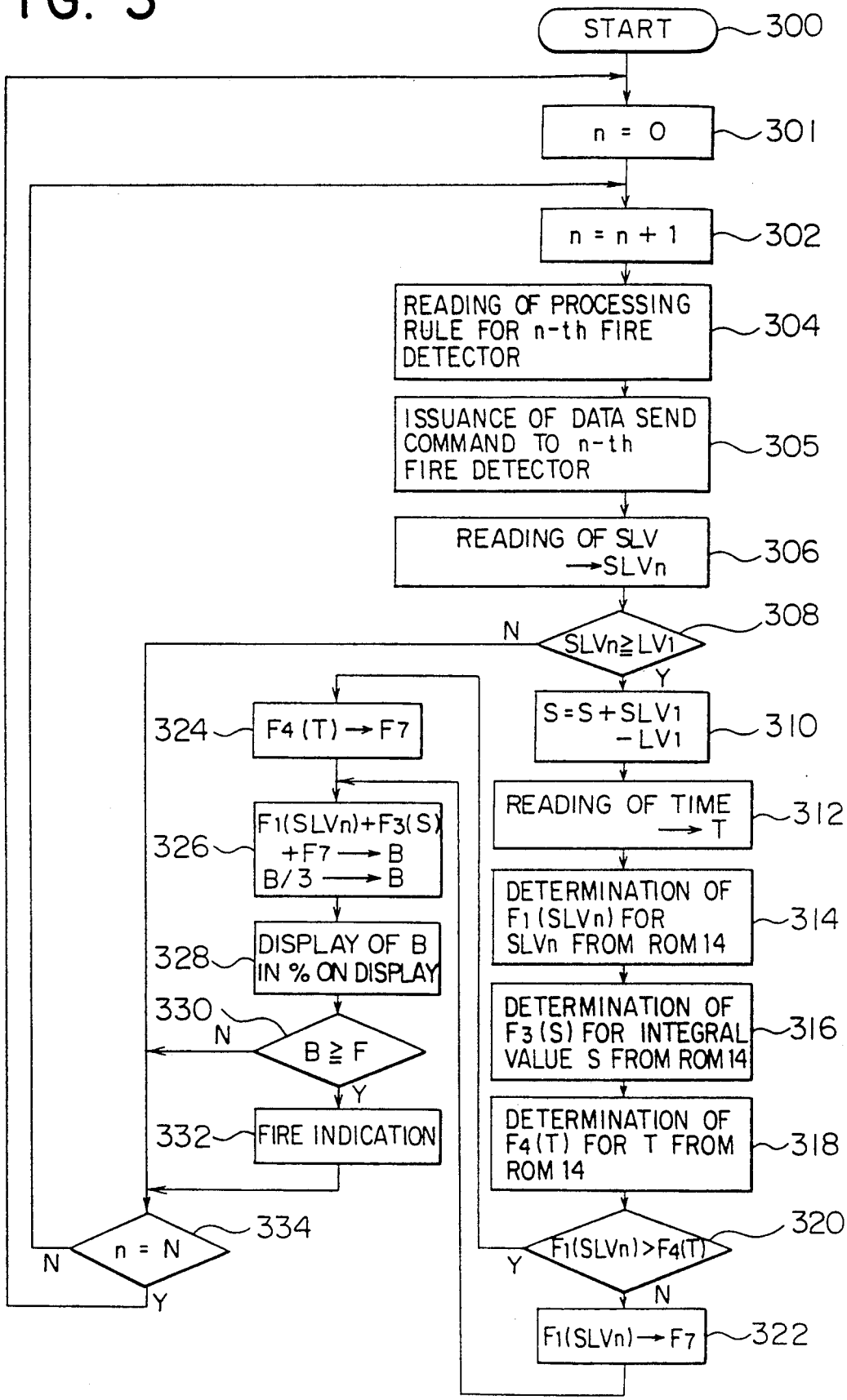
FIG. 3 is a flow chart for illustrating the operation of a fire receiver part in the fire alarm system shown in FIG. 1.
Figure 4:
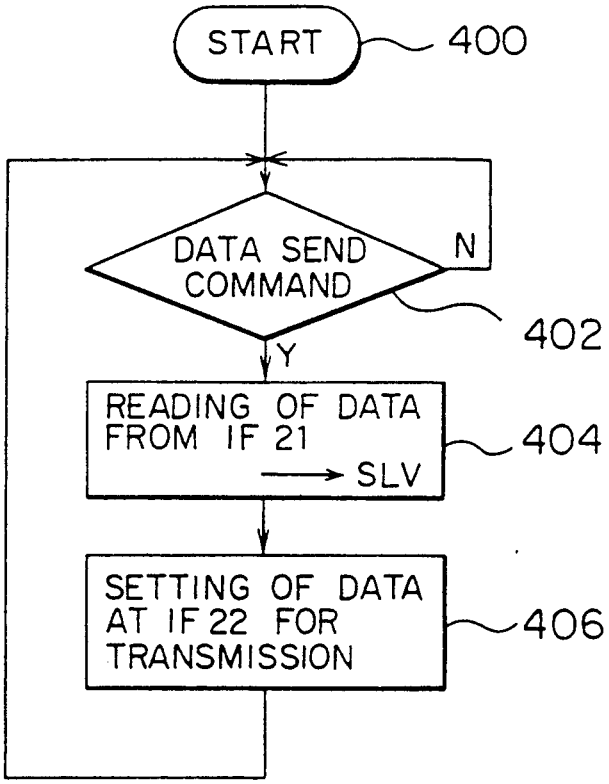
FIG. 4 is a flow chart for illustrating the operation of a fire detector in the fire alarm system shown in FIG. 1.

Now, operation of the fire alarm system shown in the block circuit of FIG. 1 will be explained by reference to the flow charts shown in FIGS. 3 and 4.

The fire receiver RE shown in FIG. 1 performs signal processing sequentially from the first to N-th detectors $DE_1$ to $DE_N$. In the following description, the first fire detector $DE_1$ will be considered as representative of the other fire detectors. For the first fire detector $DE_1$, the processing rules (i), (iii) and (vii) described hereinbefore are adopted. Accordingly, the definition functions illustrated in FIG. 2 (a), (b) and (c) are used.

In the fire receiver RE, the processing rules (i), (iii) and (vii) for the first fire detector $DE_1$ are read out from the area allocated to the first fire detector $DE_1$ of the processing storage area ROM15 (step 304), being followed by issuance of a data send command to the first fire detector $DE_1$ (step 305). In case the signal processing now under consideration is to be performed as per the processing rules (i), (iii) and (vii), it is only the sensor levels SLV that are to be collected as the data from the fire detectors, as can be understood from the elucidation of the rules (i), (iii) and (vii) made hereinbefore. Accordingly, the command to be sent out as the data send command concerns only the sensor level.

Upon reception of the data send command from the fire receiver RE by the first fire detector $DE_1$ ("Y" at step 402), the sensor level SLV is read out from the fire phenomenon detecting sensor part FS through the interface IF21 and set at the interface IF22 to be subsequently sent to the fire receiver RE through the signal transmission/reception part TRX2 via the transmission line L (step 406).

Upon reception of the data, i.e. the sensor level $SLV_1$ sent from the first fire detector $DE_1$ by the fire receiver RE, the sensor level $SLV_1$ is stored in the work area RAM11 (step 306), and then a decision is made as to whether or not the sensor level $SLV_1$ is higher than a predetermined level $LV_1$ (step 308) inclusive thereof.

In case the level $SLV_1$ is lower than the predetermined level $LV_1$ ("N" at the step 308), the procedure proceeds to the processing for the next fire detector without performing any processing for the fire detector $DE_1$.

On the other hand, when the sensor level $SLV_1$ is higher than the predetermined level $LV_1$ inclusive ("Y" at step 308), the integral values of the sensor level $SLV_1$ over a period during which it is higher than the predetermined level $LV_1$ inclusive is determined for the instant processing according to the rule (iii) (step 310), while the time T is read out from the clock CL through the interface IF14 for the processing (vii) (step 312).

Subsequently, for the processing according to the rule (i), the definition function value $F_1(SLV_1)$ for the sensor level $SLV_1$ is determined with the aid of the definition function shown in FIG. 2(*a*) and stored in the definition function storage area ROM14 (step 314), while for the processing according to the rule (iii), the definition function value $F_3(S)$ for the integral value S is determined with the aid of the definition function shown in FIG. 2(*c*) and stored in the storage area ROM14 (step 316). Further, as a part of the processing according to the rule (vii), the definition function value $F_4(T)$ for the time T is determined by consulting the definition function shown in FIG. 2(*d*) and stored in the storge area ROM14 (step 318).

Next, as the additional processing according to the rule (vii), the definition function value $F_1(SLV_1)$ is compared with $F_4(T)$ (step 320), whereby the smaller value is retained as $F_7$ (step 322 or 324).

Finally, a mean value B of $F_1(SLV_1)$, $F_3(S)$ and $F_7$ is determined (step 326), whereon the value B is displayed on the display unit DP as the fire likelihood ratio in % through the interface IF12 (step 328).

Finally, the fire likelihood ratio B is compared with a reference value F for the fire likelihood ratio stored in the various constants table storage area ROM12 (step 330). When the fire likelihood ratio is higher than the reference value F inclusive thereof, a fire indication is generated on the display unit DP (step 332), whereon the procedure proceeds to the signal processing for the next fire detector.

While the above embodiment of the invention has shown application of the different rules to each fire detector, it is possible to apply the same processing rule in common to all the fire detectors if they are installed in the same environment. In this case, by incorporating the processing rule in the program stored in the ROM11, the processing rule storage area ROM15 can be rendered unnecessary. Further, the definition functions stored in the storage area ROM14 may be limited only to those that are required for the processing rule applicable equally to all the fire detectors. Besides, it is possible to delete the step 304 shown in FIG. 3 from the program stored in the storage area ROM11, whereby the program can be simplified correspondingly.

According to the embodiment of the invention described above, the functions for the fire information are defined for every piece of data obtained by the data acquisition means and the rules for the processing to be performed with the aid of the functions are appropriately selected and previously defined in consideration of the environmental conditions so that the fire information can be obtained by processing the acquired data in the light of the processing rules as defined to thereby allow the centroid to be calculated by averaging the fire information obtained. Thus, it is possible to take into consideration the information or data acquired over a wide range and narrow down this wide range of information to a proper value, whereby highly reliable fire information can be obtained.

Figure 5:
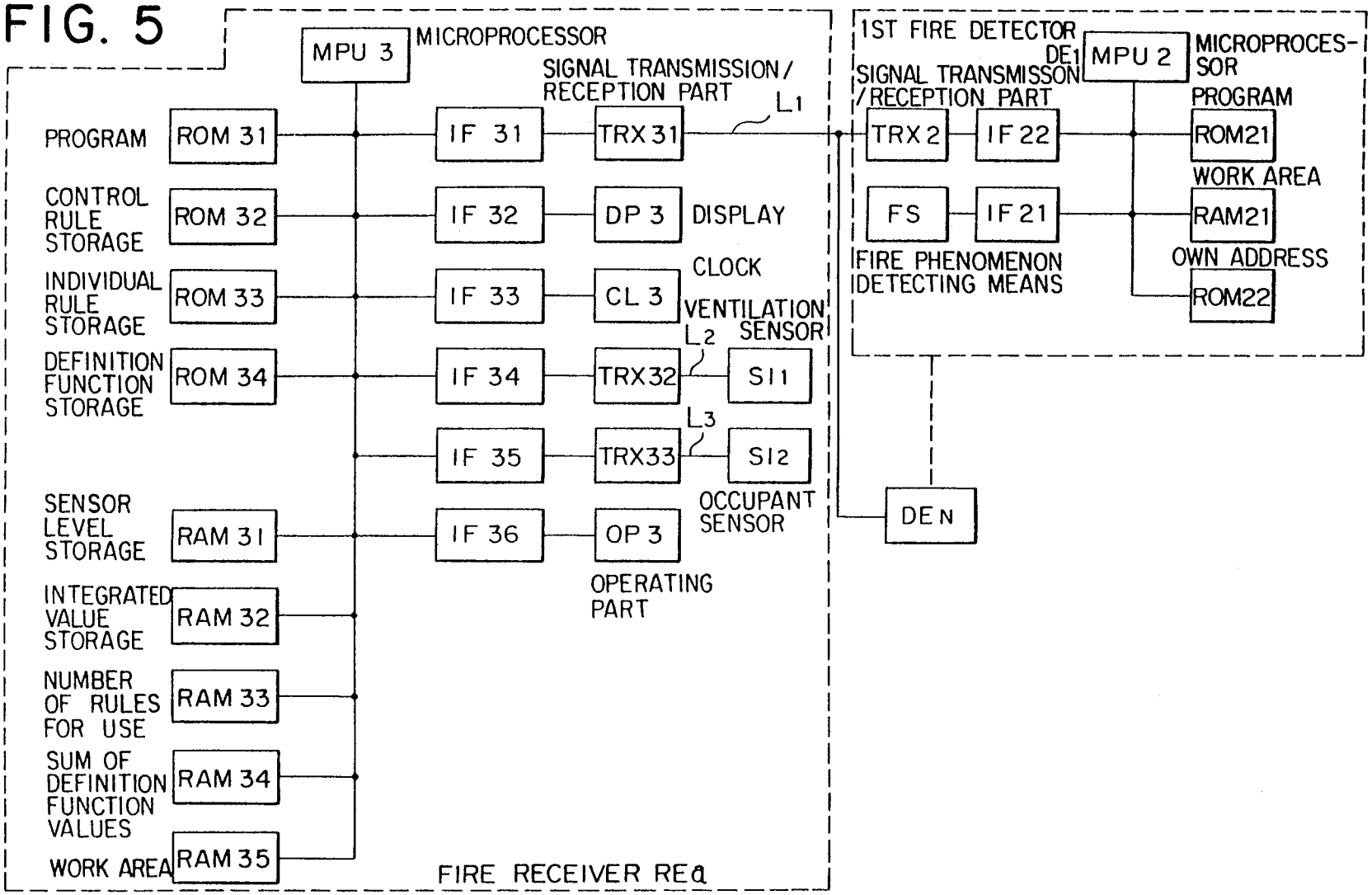
FIG. 5 is a block circuit diagram showing a fire alarm system to which a second embodiment of the present invention is applied.
Figure 6A:
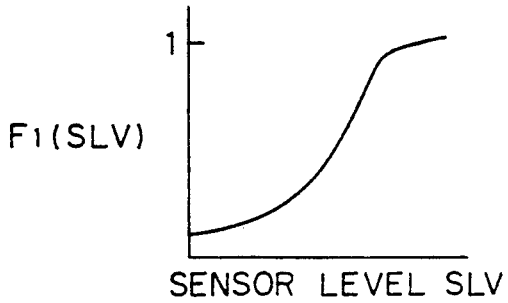
FIGS. 6(*a*)–6(*f*) examples of definition functions which can be employed according to the second embodiment.
Figure 6E:
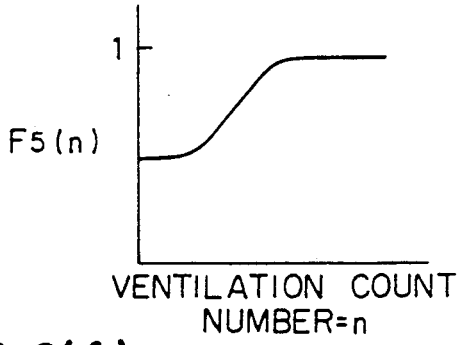
Figure 6B:
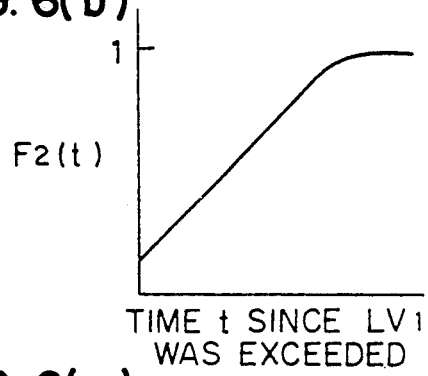
Figure 6F:
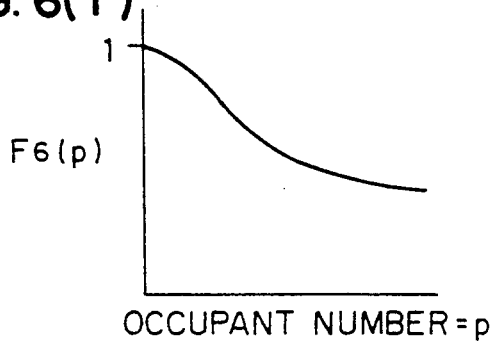
Figure 6C:
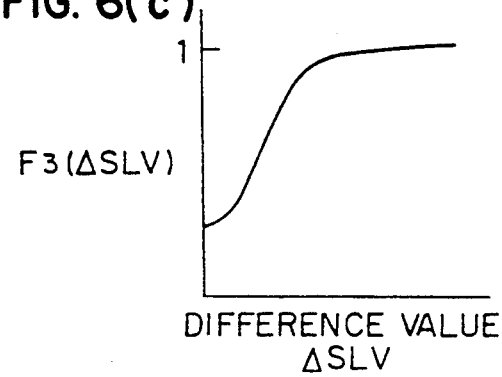
Figure 6D:
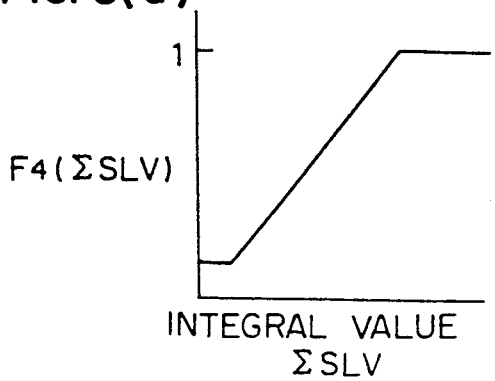

Next, referring to FIGS. 5 to 9, another exemplary embodiment, i.e. the second embodiment of the present invention will be described. FIG. 5 shows in a block circuit diagram of a so-called analogue type fire alarm system to which the instant embodiment is applied and in which sensor levels representing the analogue physical quantities based on the fire phenomena detected by the individual fire detectors are sent to a receiving part such as a fire receiver $RE_a$, repeater or the like, wherein the receiving part, a decision as to occurrence of the fire is made on the basis of the sensor levels collected. It should however be appreciated that the instant embodiment is equally applicable to an on/off type fire alarm system in which the fire decision is made at the side of the individual fire detectors and only the results of such decisions are sent to the receiving part, as described hereinbefore in conjunction with the first embodiment.

In FIG. 5, $RE_a$ denotes a fire receiver, and $DE_1$ to $DE_N$ denote N analogue type fire detectors connected to the fire receiver $RE_a$ through a transmission line $L_1$ constituted, for example, by a pair of lines serving for both the power supply and the signal transmission, wherein only one of the fire detectors, i.e. the first detector $DE_1$, is shown with detail in respect to the internal circuit configuration.

Connected to the fire receiver $RE_a$ through transmission lines $L_2$ and $L_3$ are a ventilation frequency count sensor (i.e. a sensor for detecting ventilation frequency during a predetermined period) and an occupant number count sensor (i.e. a sensor for detecting the number of occupants in a room of concern) respectively. The ventilation frequency count sensor and the occupant number count sensor may be installed, for example, in each room and provided for each fire detector or one each for a predetermined number of fire detectors, and the correspondence of the individual fire detectors to the ventilation frequency count sensors and the occupant number count sensors can be found in a reference table or the like. In FIG. 5, there are shown only the ventilation frequency count sensor $SI_1$ and the occupant number count sensor $SI_2$ that are associated with the first fire detector $DE_1$.

In the fire receiver $RE_a$:

MPU3 denotes a microprocessor;

ROM31 denotes a program storage area for storing a program relevant to the operation of the inventive system described hereinafter;

ROM32 denotes a storage area for storing control rules for control purposes;

ROM33 denotes a storage area for individual rules;

ROM34 denotes a storage area for definition functions of the individual rules, i.e. various definition functions such as a definition function for the sensor level SLV, a definition function for an integral value, a temporal definition function and others; and

RAM31 denotes a sensor level storage area for storing the sensor levels collected through the individual sensors, respectively, wherein a plurality of sensor levels collected for a number of times from each of the fire detectors are stored on a fire-detector basis.

Further;

RAM32 denotes a storage area for the integral value;

RAM33 denotes a storage area for storing the number of the rules to be used;

RAM34 denotes a storage area for a summed definition function value;

DP3 denotes a display unit such as a CRT or the like;

OP3 denotes an operating or manipulating part;

CL3 denotes a clock;

TRX31 denotes a signal transmission/reception part constituted by a serial-to-parallel converter, a parallel-to-serial converter and others for connecting the fire detectors $DE_1$ to $DE_N$ to the fire receiver $RE_a$;

TRX32 denotes a signal transmission/reception part for connecting the ventilation frequency count sensor $SI_1$ mentioned above;

TRX33 denotes a signal transmission/reception part for connecting the occupant number count sensor $SI_2$; and

IF31 to IF36 denote interfaces, respectively.

Since the fire detector $DE_1$ may be implemented in the same structure as that shown in FIG. 1, a repeated description thereof will be unnecessary.

According to the instant embodiment of the invention, the rules for making a decision as to the occurrence of a fire on the basis of the data collected from the individual fire detectors and the associated environment sensors can be selected in accordance with the prevailing situation.

More specifically, there are stored in the control rule storage area ROM32 incorporated in the fire receiver $RE_a$ the control rules which are to be adopted in dependence on the environmental situations, as exemplified below.

Control rule 1: Rules a, b, d and e are to be selected, when a room of concern is ventilated during a period from $T_1$ to $T_2$.

Control rule 2: Rules a, b, d and f are to be selected, unless the room is ventilated during the period from $T_1$ to $T_2$.

Control rule 3: Rules a, b and d are to be selected, when the room is ventilated during a period other than from $T_1$ to $T_2$.

Control rule 4: Rules a, b and f are to be selected, unless the room is ventilated during a period other than from $T_1$ to $T_2$.

In this way, the rules to be adopted are selected appropriately.

Stored in the individual rule storage area ROM33 of the fire receiver $RE_a$ are the contents of the various rules such as the individual rules a to f together with addresses of the definition functions used in conjunction with these individual rules, as exemplified below.

Rule a: If the sensor level SLV=X, then the fire likelihood ratio as the fire information should be $F_1(X)$. Accordingly, the fire likelihood ratio is determined as the fire information by using the definition function which starts from the address $AD_1$ of the storage area ROM34.

Rule b: If the time lapse t from the time point the sensor level SLV exceeded a predetermined level $LV_1$ is equal to T, the fire likelihood ratio should be $F_2(T)$. Accordingly, the fire likelihood ratio is determined as the fire information by using the definition function which starts from the address $AD_2$ of the storage area ROM34.

Rule c: If the difference value ΔSLV of the sensor level SLV over a predetermined time span is equal to Y, the fire likelihood ratio should be $F_3(Y)$. Accordingly, the fire likelihood ratio is determined as the fire information by using the definition function which starts from the address $AD_3$ of the storage area ROM34.

Rule d: When the integrated value ΣSLV of the sensor level SLV from the time point the level SLV exceeded the predetermined level $LV_1$ is equal to M, the fire likelihood ratio should be $F_4(M)$. Accordingly, the fire likelihood ratio is determined as the fire information by using the definition function which starts from the address $AD_4$ of the storage area ROM34.

Rule e: When the ventilation frequency n(/hour) in a room equipped with the fire detector of concern is equal to N/, the fire likelihood ratio should be $F_5(N)$. Accordingly, the fire likelihood ratio as the fire information is determined by using the definition function which starts from the address $AD_5$ of the storage area ROM34.

Rule f: When the number p of the occupants in a room equipped with the fire detector of concern is equal to P, the fire likelihood ratio should be $F_6(P)$. Accordingly, the fire likelihood ratio as the fire information is determined by using the definition function which starts from the address $AD_6$ of the storage area ROM34, and so forth.

Finally, there are stored in the definition function storage area ROM34 incorporated in the fire receiver $RE_a$ the practical function values, i.e. the definition functions for the various rules such as those a to f in the form of formulae or tables. Examples of the definition functions for the rules a to f stored in the storage area ROM34 are illustrated in FIG. 6 at (a) to (f), wherein the fire likelihood ratios are shown as the fire information (taken along the ordinates) for the various acquired or input data (taken along the abscissa).

There is shown in FIG. 6(*a*) the definition function $F_1(SLV)$ or the fire likelihood ratio in a range of 0 to 1 for the sensor level SLV supplied as the input data from the fire phenomenon detecting sensor part FS.

In FIG. 6(*b*), there is shown the definition function $F_2(t)$ of the fire likelihood ratio for the time lapse t as of the time point the sensor level exceeded the predetermined level $LV_1$.

In FIG. 6(*c*), there is shown the definition function $F_2(\Delta SLV)$ of the fire likelihood ratio for the difference value ΔSLV of the sensor level.

In FIG. 6(*d*), there is shown the definition function $F_4(\Sigma SLV)$ of the fire likelihood ratio for the integrated value ΣSLV of the sensor level.

In FIG. 6(*e*), there is shown the definition function $F_5(n)$ of the fire likelihood ratio for the ventilation frequency n/hour as the environmental data in the case where the ventilation frequency/hour exerts an influence on the fire decision value.

In FIG. 6(*f*), there is shown the definition function $F_G(p)$ of the fire likelihood ratio for the number of occupants within a room of concern as the environmental information.

Of course, other various definition functions may be stored in the definition function storage area ROM34 so as to be read out for use, as occasion requires.

Parenthetically, the storage areas ROM32, ROM33 and ROM34 mentioned above should preferably be so implemented that they can be rewritten or exchanged, if it is necessary, in view of changes or variations in environmental conditions.

Figure 7:
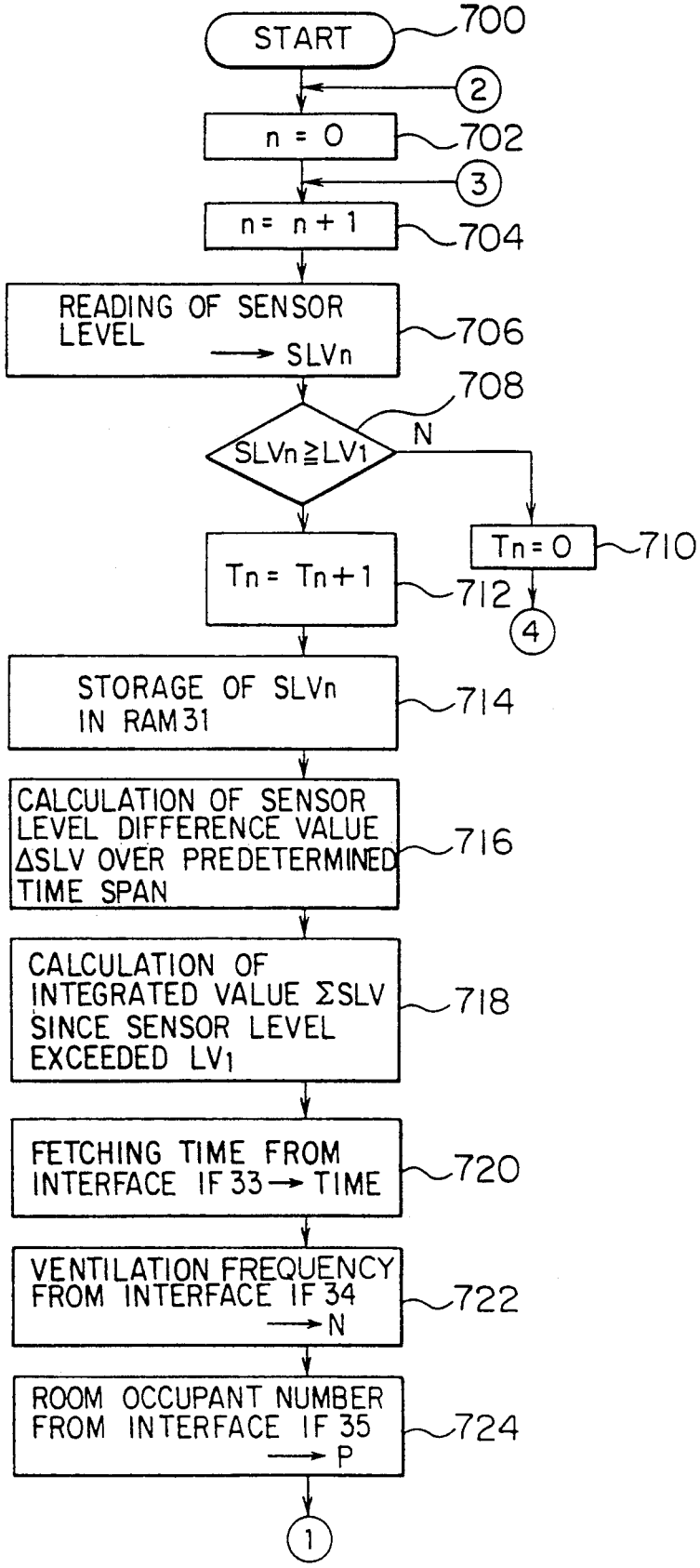
FIGS. 7 and 8 show flow charts for illustrating the operation of a fire receiver part in the fire alarm system shown in FIG. 5.
Figure 8:
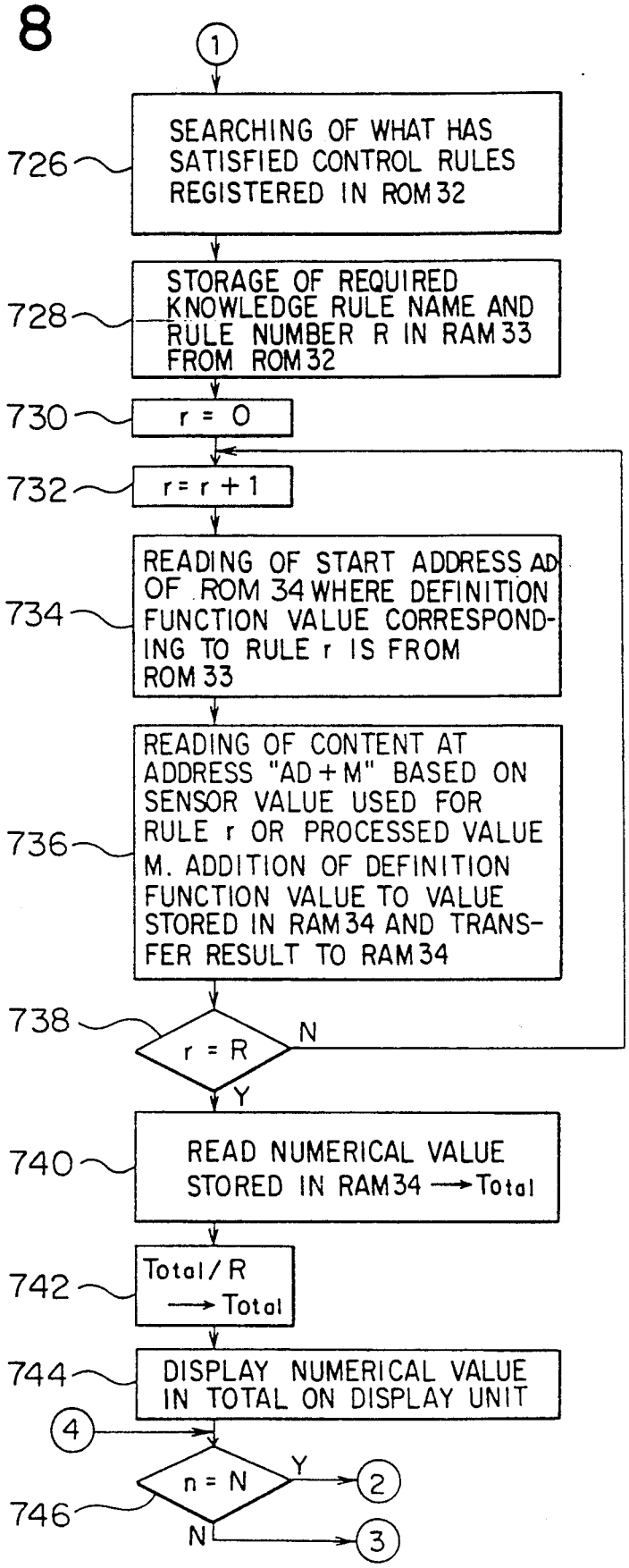

Now, the operation of the system shown in FIG. 5 will be explained by reference to the flow charts shown in FIGS. 7 and 8.

In the fire receiver $RE_a$, data is collected from the first to N-th fire detectors $DE_1$ to $DE_N$ sequentially to undergo subsequent signal processing. The following description is directed to the signal processing performed in conjunction with the first fire detector $DE_1$. After having sent a data collect command to the first fire detector $DE_1$, the fire receiver $RE_a$ receives the sensor level $SLV_1$ of the first fire detector $DE_1$ (step 706) to compare the sensor level $SLV_1$ with a predetermined level $LV_1$ (step 708). When the sensor level $SLV_1$ is lower than the predetermined level $LV_1$ ("N" at a step 708), no further processing for the first fire detector $DE_1$ is performed but the variable T for counting the time period during which the sensor level $SLV_1$ is higher than the predetermined level $LV_1$ inclusive is cleared, whereon the signal processing operation for the next fire detector $DE_2$ is preceeded with.

On the other hand, when the sensor level $SLV_1$ is higher than the predetermined level $LV_1$ inclusive ("Y" at step 708), the sensor level $SLV_1$ is then stored in the sensor level storage area RAM31 (step 714) and the variable $T_1$ for counting the time period during which the sensor level $SLV_1$ is higher than the predetermined level $LV_1$ inclusive is incremented by "1" (one) (step 712), which is then followed by the signal processing operation for the first fire detector $DE_1$.

At first, the decision must be made as to which of the control rules stored in the control rule storage area ROM32 is to be applied to the processing for the first fire detector $DE_1$. To this end, the time "Time" is fetched from the clock CL3 through the interface IF33 (step 720), while the ventilation frequency N is fetched through the interface IF34 from the ventilation frequency count sensor $SI_1$ associated with the first fire detector $DE_1$ (step 722).

Further, after the control rule to be applied has been determined, the data collecting and/or arithmetic operation is performed for obtaining the data to be used in performing the signal processing operation in accordance with the control rule as determined. In the case of the instant embodiment, there are arithmetically determined in addition to the variable $T_1$ (step 712) mentioned above the difference value $\Delta SLV$ of the sensor level (step 716) and the integral value $\Sigma SLV$ of the sensor level $SLV_1$ since the time point the sensor level $SLV_1$ exceeded the predetermined level $LV_1$ (step 718). Further, the occupant number P in the room associated with the first fire detector $DE_1$ is collected from the occupant number count sensor $SI_2$ through the signal transmission/reception part TRX33 and the interface IF35 (step 724).

The difference value $\Delta SLV$ can be arithmetically determined, for example, by dividing the difference between the sensor level collected currently and the sensor level collected immediately before, both being stored in the sensor level storage area RAM31, by the difference in time between the current sampling time point and the immediately preceding sampling time point. On the other hand, arithmetic determination of the integrated value $\Sigma SLV$ is performed every time a sensor level $SLV_1$ higher than the predetermined level $LV_1$ inclusive is fetched from the first fire detector $DE_1$ of concern by adding a value $(SLV_1-LV_1)$ by which the sensor level $SLV_1$ exceeds the predetermined level $LV_1$ to the integrated value $\Sigma SLV$ stored in the integral value storage area RAM32 till the immediately preceding sampling time point. With the result of this addition, the value integrated till the immediately preceding sampling time point and stored in the integral value storage area RAM32 is updated. More specifically, the content $\Sigma SLV=(RAM32)$ of the integral value storage area RAM32 at the immediately preceding sampling point is updated as follows:

$$(RAM32)+SLV_1-LV_1$$

Once the various pieces of information or data mentioned above have been collected and/or arithmetically determined, then a decision is made as to which of the control rules stored in the control rule storage area ROM32 is to be applied on the basis of the data concerning the time "Time" and the ventilation frequency N obtained at the steps 720 and 722 (step 726). For example, when a decision is made from the temporal data "Time" and the ventilation frequency data N that the time of concern lies between $T_1$ and $T_2$ and that the room equipped with the fire detector of concern is ventilated, respectively, then the control rule 1 mentioned hereinbefore is decided to be adopted.

Now, the description is further proceeded with the case where the control rule 1 has been adopted. There are stored in the area for the control rule 1 within the storage area ROM32 the knowledge rule names a, b, d and e, the addresses of the storage areas ROM33 at which detailed information or data for these rules and the rule number R=4 are stored. This data is read out to be written in the rule number storage area RAM33 (step 728).

Figure 9:
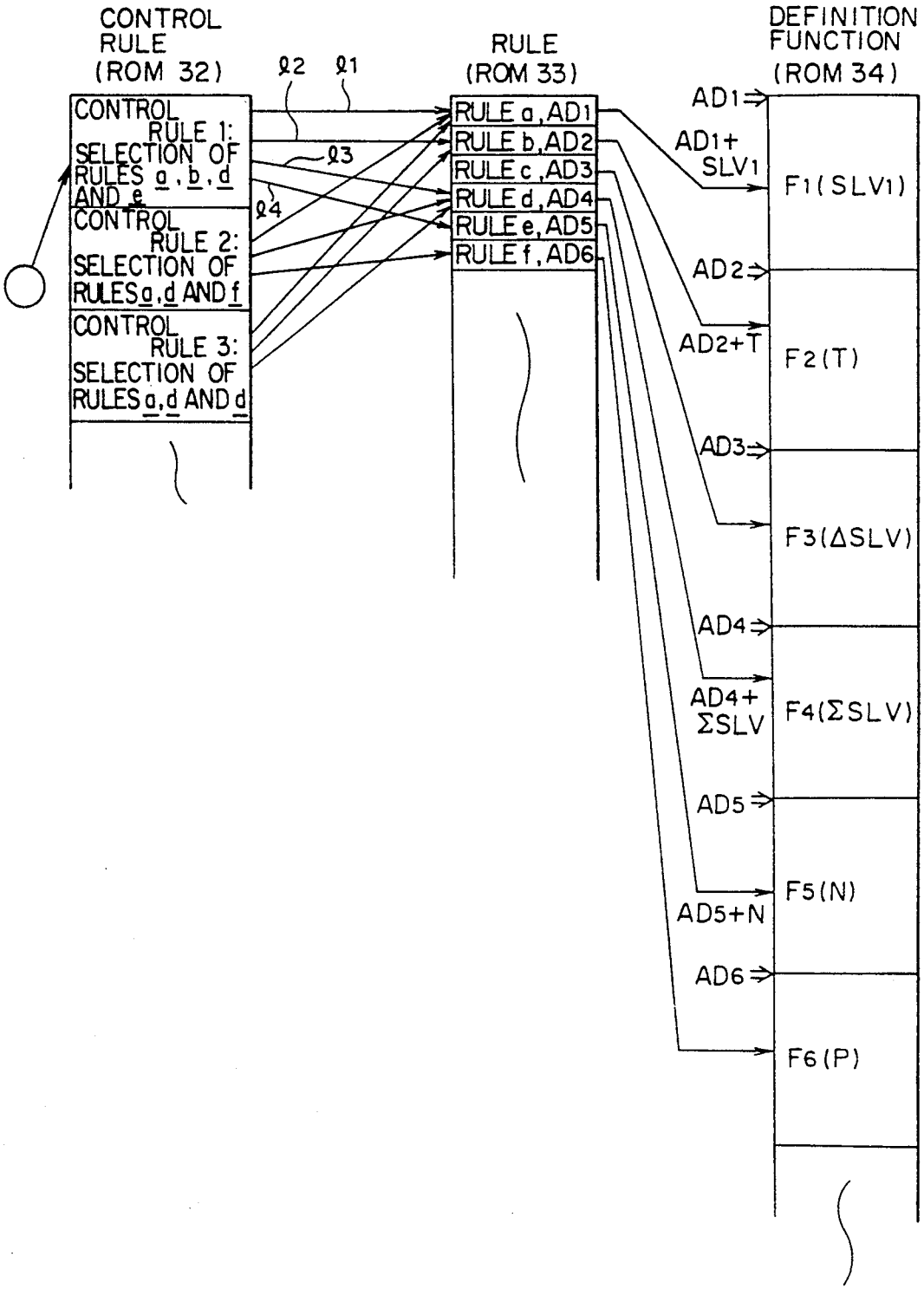
FIG. 9 is a conceptual diagram for illustrating relations among storage areas ROM32, ROM33 and ROM34.

As is conceptually indicated by lines $l_1$, $l_2$, $l_3$ and $l_4$ in FIG. 9, it is possible to know from the addresses of the knowledge rule names a, b, d and e the storage locations in the individual rule storage area ROM33 at which the addresses of the definition functions to be used for the abovementioned individual rules as the detailed data are stored.

Subsequently, the four rules read out from the area for storing the control rule 1 within the storage area ROM32 are sequentially processed in a manner described below. First, the processing for the rule a will be described. The start address $AD_1$ of the area in the definition function storage area ROM34 where the definition function corresponding to the rule a and illustrated in FIG. 6(*a*) is stored is read out from the storage area ROM33 (step 734). Next, the value of the input data to be used in the rule a, i.e. the latest sensor level $SLV_1$ stored in the storage area RAM31 at the step 714 is added to the start address $AD_1$, whereon the content at the address $(AD_1+SLV_1)$ of the area where the definition function shown in FIG. 6(*a*) is read out to be stored in the storage area RAM34 for the summed definition function value (step 736). The content at the address $(AD_1+SLV_1)$ of this area corresponds to the definition function value representing the fire likelihood ratio $F_1(SLV_1)$ for the sensor level $SLV_1$.

The processing for the next rule b is also performed similarly (step 732). The start address $AD_2$ of the area in the definition function corresponding to the rule b and shown in FIG. 6(*b*) is stored is read out from the storage area ROM33 (step 734). Next, the value of the input data to be used in the rule b, i.e. the time lapse $T_1$ from the time point the sensor level $SLV_1$ exceeded the predetermined level $LV_1$ (already determined at the step 712) is added to the start address $AD_2$, and the content at the address of $(AD_2+T_1)$ where the definition function shown in FIG. 6 at (b), i.e. the fire likelihood ratio $F_2(T_1)$, is stored is read out to be added to the fire likelihood ratio $F_1(SLV_1)$ stored in the storage area RAM34 which stores therein the summed definition function value mentioned above (step 736).

Similar processing is performed in conjunction with the rules d and e, whereby the fire likelihood ratios $F_4(\Sigma SLV)$ and $F_5(N)$ are determined on the basis of the integral value $\Sigma SLV$ and the ventilation frequency N already determined at the steps 718 and 722, respectively. These fire likelihood ratios are added to the storage area RAM34 storing the definition function sum value (step 736).

Upon completion of all the processings for the rules a, b, d and e as adopted ("Y" at a step 737), the total sum value of the fire likelihood ratio given by $F_1(SLV_1)+F_2(T_1)+F_4(\Sigma SLV)+F_5(N)$ is read out from the storage area RAM34 (step 740), whereon the sum value is divided by the rule number, i.e. 4 in this case (step 742). The quotient resulting from the division is displayed on the display unit DP3 (step 744) and compared with an appropriate reference value for triggering the proper anti-fire measures such as generation of a fire indication when the former exceeds the latter.

In this manner, the signal processing for the first fire detector $DE_1$ is completed, which is then followed by similar processing for the second fire detector $DE_2$ et seq.

In the foregoing description of the second embodiment of the invention, it has been assumed that the control rules have the contents of the rules 1 to 4 with the rules a to f being adopted for the processing while the definition functions shown in FIG. 6(*a*) to (*f*) are employed. However, this is only for the purpose of explanation. It can readily be understood that the contents of these control rules, the processing rules and the definition functions can appropriately be altered or modified in dependence on the environmental conditions in which the present invention is practiced.

As will be appreciated from the above description, according to the embodiment illustrated in FIGS. 5 to 9 in which the functions for the fire information are defined for every data obtained by the data acquisition means with a plurality of rules for the processings to be executed by using the functions being also defined, wherein the data made available by the data acquisition means are processed on the basis of the processing rules determined and the functions corresponding to these processing rules, it is possible to employ the processing rules while selecting or altering them appropriately in accordance with the environmental conditions to thereby allow only the effective rules suited for the given environmental condition to be adopted. Thus, a fire alarm system having a remarkably high reliability can be realized.

Figure 10:
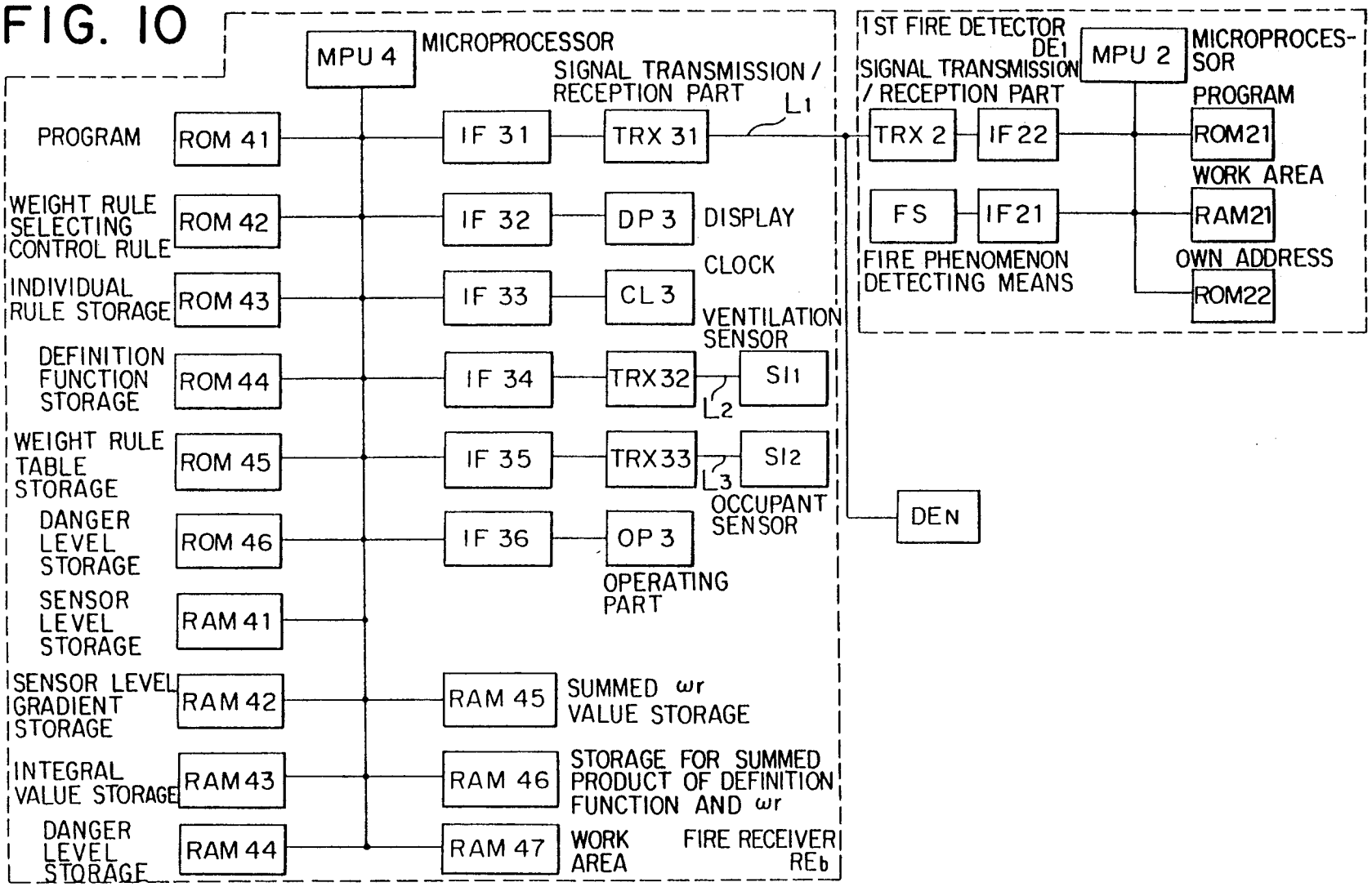
FIG. 10 is a block circuit diagram showing a fire alarm system to which a third embodiment of the present invention is applied.
Figure 11A:
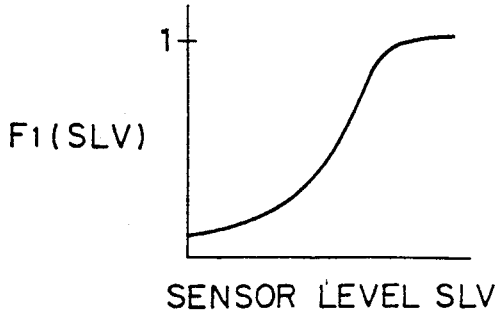
FIGS. 11(*a*)–11(*g*) show examples of definition functions which can be employed according to the third embodiment.
Figure 11B:
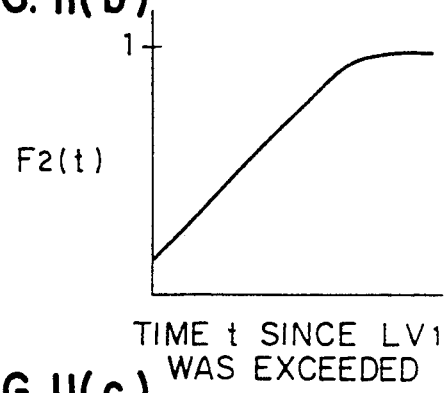
Figure 11C:
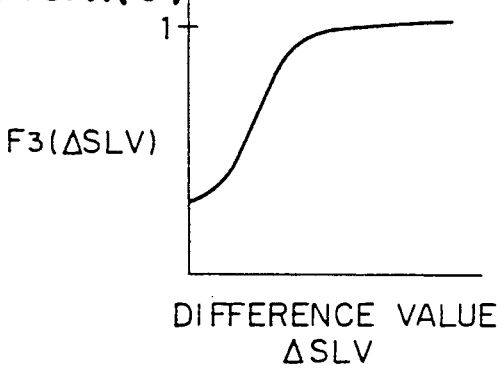
Figure 11D:
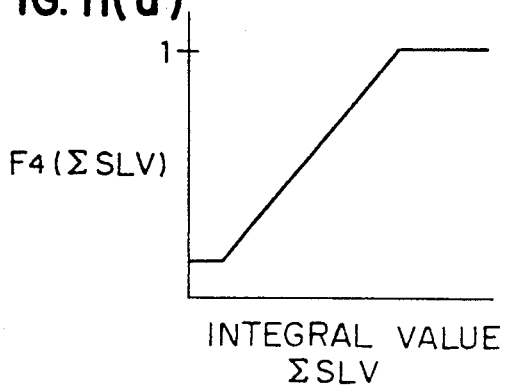
Figure 11E:
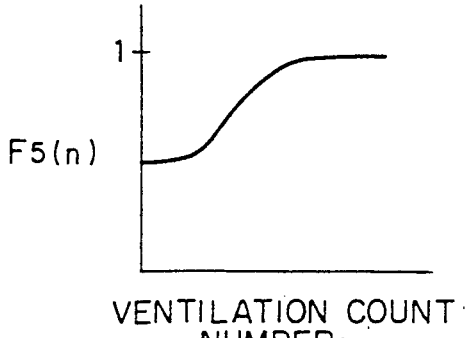
Figure 11F:
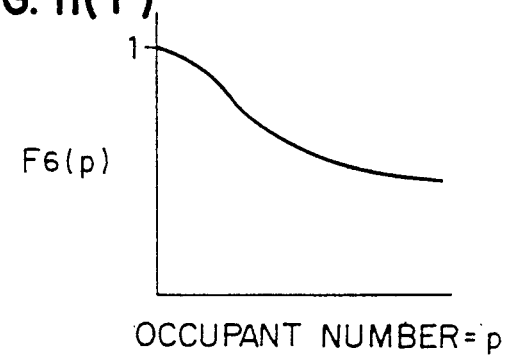
Figure 11G:
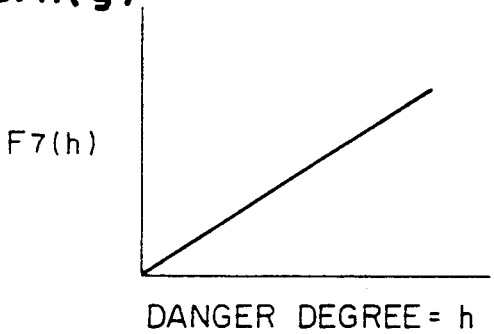

Next, referring to FIGS. 10 to 15, still another exemplary embodiment, i.e. the third embodiment of the present invention will be described. FIG. 10 shows in a block circuit diagram a so-called analogue type fire alarm system to which the instant embodiment is applied and in which sensor levels representing analogue physical quantities based on the fire phenomena and detected by the individual fire detectors are sent to the receiving means such as a fire receiver $RE_b$, repeater or the like, wherein in the receiving means, decision as to occurrence of the fire is made on the basis of the sensor levels collected. It should however be appreciated that the instant embodiment is equally applicable to an on/-off type fire alarm system in which the fire decision is made at the side of the individual fire detectors and only the results of the decision are sent to the receiving means, as mentioned hereinbefore in conjunction with the first and second embodiments.

In FIG. 10, $RE_b$ denotes a fire receiver, and $DE_1$ to $DE_N$ denote N analogue type fire detectors similar to those described hereinbefore in conjunction with the first and second embodiments.

Connected to the fire receiver $RE_b$ through transmission lines $L_2$ and $L_3$ are a ventilation frequency count sensor $SI_1$ and occupant number count sensors $SI_2$ respectively, as in the case of the second embodiment shown in FIG. 5.

In the fire receiver $RE_b$:

MPU4 denotes a microprocessor;

ROM41 denotes a program storage area for storing a program relevant to the operation of the inventive system described hereinafter;

ROM42 denotes a storage area for storing weight rule selection controlling rules;

ROM43 denotes a storage area for individual rules;

ROM44 denotes a storage area for the definition functions of the individual rules, i.e. the various definition functions such as a definition function for the sensor level SLV, a definition function for an integrated value, a definition function concerning the time and others;

ROM45 denotes a storage area for a weight rule table;

ROM46 denotes a storage area for storing degrees of or level of danger in association with each of the fire detectors; and

RAM41 denotes a sensor level storage area including the locations for storing the sensor levels collected from the individual fire detectors, respectively, wherein a plurality of sensor levels collected for a number of times from each of the fire detectors are stored on a fire-detector basis for the purpose of determining gradients described hereinafter.

Further:

RAM42 denotes a storage area for storing the gradient of the sensor levels;

RAM43 denotes a storage area for the integrated value;

RAM44 denotes a storage area for storing the degrees of danger or the danger levels;

RAM45 denotes a storage area for a sum of the weighting values $\omega$rs;

RAM46 denotes a storage area for storing a sum of the products of the definition functions and the weighting values $\omega$rs; and

RAM47 denotes a work area. Since the display unit DP3, the operating or manipulating unit OP3, the clock CL3, the signal transmission/reception units TRX31, TRX32 and TRX33 and the interfaces IF31 to IF36 are similar to those of the second embodiment shown in FIG. 5, a repeated description thereof will be unnecessary. Further, since the fire detector DE may be of the same structure as that of the first embodiment shown in FIG. 1 or that of the second embodiment shown in FIG. 5, a description thereof is also omitted.

The instant embodiment is so arranged that upon making an inference for the determination of a fire on the basis of the data acquired from the individual fire detectors and the associated environmental sensors, weights (weighting coefficients) are imparted to the rules adopted in the above decision in accordance with the prevailing situation.

To this end, there are stored in the definition function storage area ROM44 (see FIG. 15) incorporated in the fire receiver $RE_b$ the practical function values, i.e. the definition functions actually used in the various rules such as rules a to g, in the form of formulae or tables. Examples of definition functions for the rules a to g stored in the storage area ROM44 are illustrated in FIGS. 11(*a*) to (*g*), wherein the fire likelihood ratios are shown as the fire information (taken along the ordinates) for the various acquired or input data (taken along the abscissa).

There is shown in FIG. 11(*a*) a definition function $F_1(SLV)$ or the fire likelihood ratio in a range of 0 to 1 for the sensor level SLV supplied as the input data from the fire phenomenon detecting sensor part FS.

In FIG. 11(*b*), there is shown a definition function $F_2(t)$ of the fire likelihood ratio for the time lapse t from the time point the sensor level has exceeded a predetermined level $LV_1$.

In FIG. 11(*c*), there is shown a definition function $F_2(\Delta SLV)$ of the fire likelihood ratio for the gradient $\Delta SLV$ of the sensor level.

In FIG. 11(*d*), there is shown a definition function $F_4(\Sigma SLV)$ of the fire likelihood ratio for the integrated value $\Sigma SLV$ of the sensor level.

In FIG. 11(*e*), there is shown a definition function $F_5(n)$ of the fire likelihood ratio for the ventilation frequency n/hour a s the environmental data in the case where the ventilation frequency/hour exerts influence on the fire decision value.

In FIG. 11(*f*), there is shown a definition function $F_G(p)$ of the fire likelihood ratio for the number of occupants within a room of concern as the environmental data.

In FIG. 11(*g*), there is shown a definition function $F_7(h)$ of the fire likelihood ratio for the degree or level of danger h within the room as the environmental data.

Of course, other various definition functions may be stored in the definition function storage area ROM44 so as to be read out for use, as occasion requires.

Stored in the individual rule storage area ROM43 incorporated in the fire receiver $RE_b$ are the contents of the various rules such as rules a to g and the addresses of the storage area ROM44 for the definition functions employed in conjunction with the rules (see FIG. 15), which are exemplified below.

Rule a: If the sensor level SLV=X, then the fire likelihood ratio as the fire information should be determined to be $F_1(X)$ by using the definition function $F_1(SLV)$, which is stored in an area starting from the address $AD_1$ of the storage area ROM44.

Rule b: If the time lapse t from the time point when the sensor level SLV exceeded the predetermined level $LV_1$ is equal to T, the fire likelihood ratio as the fire information should be determined to be $F_2(T)$ by using the definition function $F_2(t)$ which is stored in an area starting from the address $AD_2$ of the storage area ROM44.

Rule c: If the difference value or gradient $\Delta SLV$ of the sensor level SLV over a predetermined time span is equal to Y, the fire likelihood ratio as the fire information should be determined to be $F_3(Y)$ by using the definition function $F_3(\Delta SLV)$ stored in an area which starts from the address $AD_3$ of the storage area ROM44.

Rule d: When the integral value $\Sigma SLV$ resulting from the integration of the sensor level SLV from the time point the level SLV exceeded the predetermined level $LV_1$ is equal to M, the fire likelihood ratio should be determined to be $F_4(M)$ by using the definition function $F_3(\Delta SLV)$ stored in an area which starts from the address $AD_4$ of the storage area ROM44.

Rule e: When the frequency n of the ventilation in the room equipped with the fire detector is equal to N/hour, the fire likelihood ratio as the fire information should be $F_5(N)$ by using the definition function $F_5(n)$ stored in an area starting from the address $AD_5$ of the storage area ROM44.

Rule f: When the number p of the occupants in the room equipped with the fire detector is equal to P, then the fire likelihood ratio as the fire information should be determined to be $F_6(P)$ by using the definition function $F_6(p)$ stored in an area starting from the address $AD_6$ of the storage area ROM44.

Rule g: When the degree or level of danger h within the room equipped with the fire detector is equal to H, the fire likelihood ratio as the fire information should be determined to be $F_7(H)$ by using the definition function $F_7(h)$ stored in an area which starts from the address $AD_7$ of the storage area ROM44, and so forth.

There are stored in the weight rule selection controlling rule storage area ROM42 (see FIG. 14) incorporated in the fire receiver $RE_b$ the weight rule controlling rules which are to be adopted selectively in dependence on the environmental situations, as exemplified below.

Weight controlling rule 1: A weight rule table A is to be selected when a room of concern is ventilated during a period from $T_1$ to $T_2$.

Weight controlling rule 2: A weight rule table B is to be selected unless the room is ventilated during the period from $T_1$ to $T_2$.

Weight controlling rule 3: A weight rule table C is to be selected when the room is ventilated during a period other than from $T_1$ to $T_2$.

Weight controlling rule 4: A weight rule table D is to be selected unless the room is ventilated during a period other than from $T_1$ to $T_2$.

Although only four weight controlling rules are shown in the case of the instant embodiment, it should be understood that in actuality a larger number of weight controlling rules may be stored in the storage area ROM42.

Figure 14:
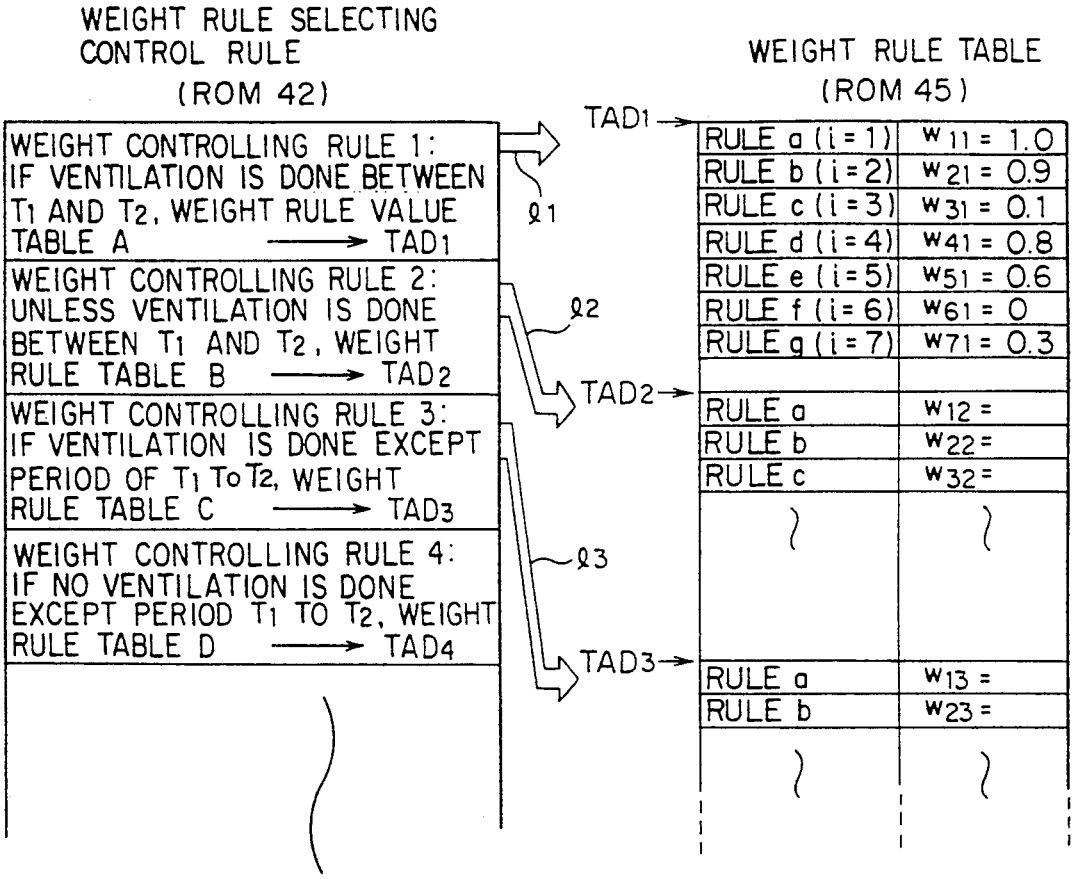
FIG. 14 is a conceptual diagram for illustrating relations between a storage area ROM42 for weighting rule selection control rules and a storage area ROM45 for a weighting rule table.

There are stored in the weight rule table storage area ROM45 of the fire receiver $RE_b$ a plurality of weight rule tables typified by the four weight rule tables A to D mentioned above, wherein each of the weight rule tables stores therein the values $\omega ij$ with which the individual rules should be weighted in the sequence in which the rules are stored in the storage area ROM43. FIG. 14 shows the state in which the weight values are stored only for the weight rule table A. In FIG. 14, $\omega ij$ where i=1 to 7 correspond to the rules a to g, respectively, while $\omega ij$ where j=1 to 4 correspond to the rule tables A to D, respectively.

Parenthetically, the storage areas ROM42, ROM43 and ROM44 mentioned above should preferably be so implemented that they can be rewritten or exchanged, if necessary, by taking into consideration changes or variations in the environmental conditions and others.

Figure 12:
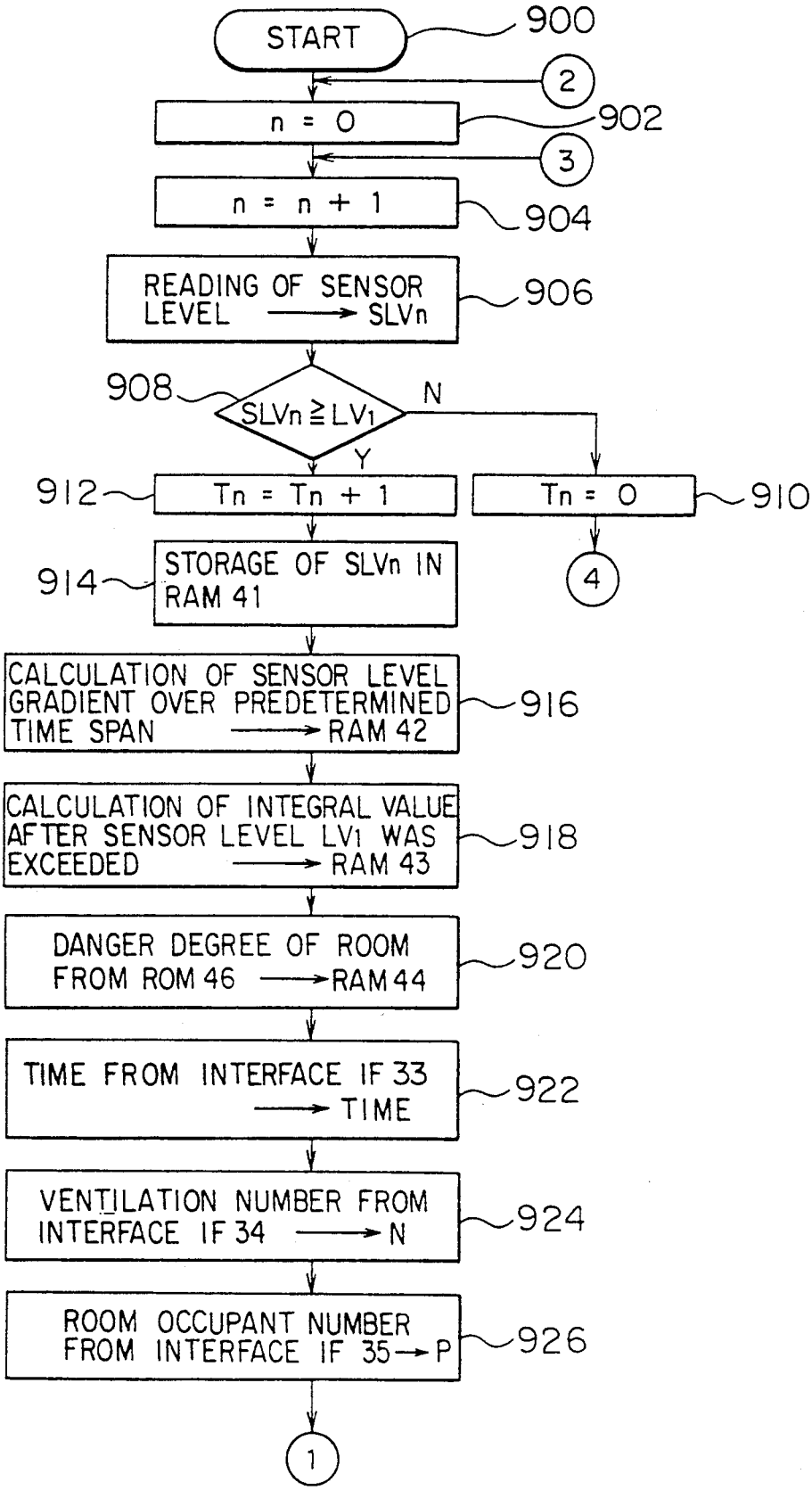
FIGS. 12 and 13 show flow charts for illustrating the operation of a fire receiver part in the fire alarm system shown in FIG. 10.
Figure 13:
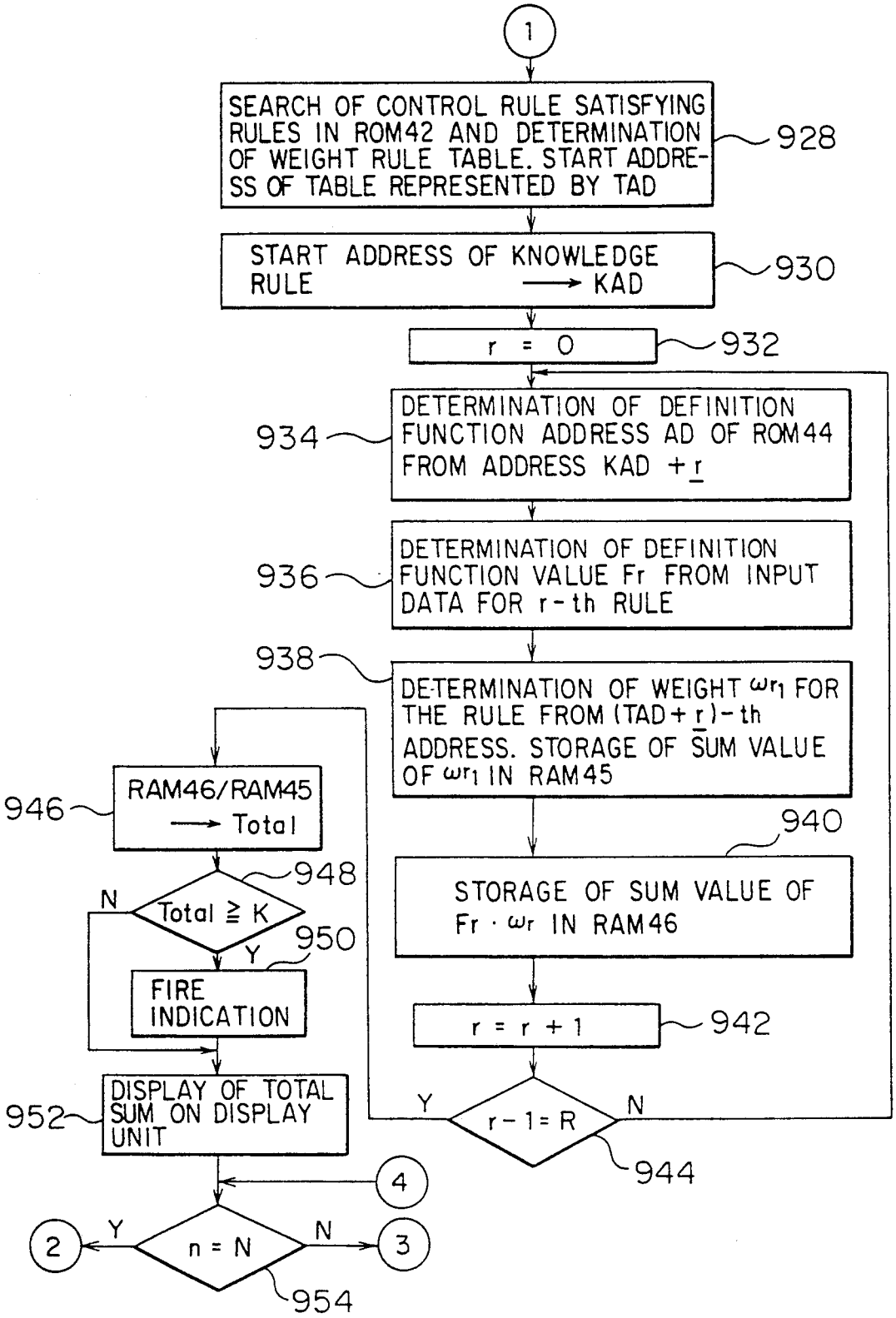

Now, the operation of the system shown in FIG. 10 will be explained by reference to flow charts shown in FIGS. 12 and 13.

In the fire receiver $RE_b$, the data are collected from the first to N-th fire detectors $DE_1$ to $DE_N$ sequentially to undergo signal processing. The following description is directed to the signal processing concerning the first fire detector $DE_1$. In response to a data collecting command to the first fire detector $DE_1$, the sensor level SLV of the first fire detector $DE_1$ is sent as $SLV_n$ (step 906) and compared with a predetermined level $LV_1$ (step 908). When the sensor level $SLV_n$ is lower than the predetermined level $LV_1$ ("N" at a step 908), no further processing for the first fire detector $DE_1$ is performed but a variable $T_n$ for counting the time period during which the sensor level is higher than the predetermined level $LV_1$ inclusive is cleared (step 910), whereon the signal processing operation for the next fire detector $DE_2$ is performed.

On the other hand, when the sensor level $SLV_n$ is higher than the predetermined level $LV_1$ inclusive ("Y" at a step 908), the sensor level $SLV_n$ is then stored in the sensor level storage area RAM41 (step 914) and the variable $T_n$ for counting the time period during which the sensor level $SLV_n$ is higher than the predetermined level $LV_1$ inclusive is incremented by "1" (one) (step 912), being then followed by the signal processing operation for the first fire detector $DE_1$, which will be described below.

At first, a decision must be made as to which of the weight controlling rules stored in the weight rule selection controlling rule storage area ROM42 is to be applied to the first fire detector $DE_1$. To this end, the time "Time" is fetched from the clock CL3 through the interface IF33 (step 922), while the ventilation frequency N is fetched through the interface IF34 from the ventilation frequency count sensor $SI_1$ that is associated with the first fire detector $DE_1$ (step 924).

Further, after the weight controlling rule to be applied has been determined, the data acquiring operation is performed for obtaining the information or data used in performing the signal processing operation in accordance with the weight controlling rule as determined. In the case of the instant embodiment, there are arithmetically determined in addition to the variable $T_1$ (step 912) mentioned above the difference value, i.e. the gradient $\Delta SLV$ of the sensor level (step 916), and the integral value $\Sigma SLV$ of the sensor level SLV since the time point the sensor level SLV exceeded the predetermined level $LV_1$ (step 718). Further, the degree of danger within the room equipped with the first fire detector $DE_1$ is read out from the storage area ROM46 to be stored in the storage area RAM44 (step 920), while the occupant number P in the room associated with the first fire detector $DE_1$ is also collected from the occupant number count sensor $SI_2$ through the signal transmission/reception part TRX33 and the interface IF35 (step 926).

The difference value $\Delta SLV$ can be arithmetically determined, for example, by dividing a difference between the sensor level collected currently and the sensor level collected immediately before, both being stored in the sensor level storage area RAM41, by a difference in time between the current sampling time point and the immediately preceding sampling time point. The value of $\Delta SLV$ thus determined is stored in the storage area RAM42.

On the other hand, arithmetic determination of the integral value $\Sigma SLV$ is performed every time a sensor level SLV higher than the predetermined level $LV_1$ inclusive is fetched from the first fire detector $DE_1$ of concern by adding a value $(SLV_1 - LV_1)$ by which the sensor level SLV exceeds the predetermined level $LV_1$ to the integral value $\Sigma SLV$ which has been stored in the integrated value storage area RAM43 at the immediately preceding sampling time point. With the result of this addition, the value integrated till the immediately preceding sampling time point and stored in the integrated value storage area RAM42 is updated. More specifically, the content $\Sigma SLV = (RAM43)$ of the integrated value storage RAM43 at the immediately preceding sampling point is updated to $(RAM43) + SLV - LV_1$.

Once the various pieces of information or data mentioned above have been acquired, then a decision is made as to which of the weight controlling rules stored in the weight rule selection controlling rule storage area ROM42 is to be applied by comparing the information concerning the time "Time" and the ventilation frequency N obtained at the steps 922 and 924 with the data of the time and the ventilation number stored in the storage area ROM42 shown in detail in FIG. 14 (step 928). For example, when a decision is made from the temporal data "Time" and the ventilation frequency N that the time of concern lies between $T_1$ and $T_2$ and that the room equipped with the fire detector of concern is ventilated, then the weight controlling rule 1 is adopted, as shown in FIG. 14.

In the following description, it is assumed that the weight controlling rule 1 has been adopted. There are stored in the area for the weight controlling rule 1 in the storage area ROM42 the start address $TAD_1$ of the area in the storage area ROM45 for the weight rule table A in addition to the time data $T_1 - T_2$ and the ventilation frequency for comparison, wherein data of the location of the weight rule table A as well as the content thereof can be obtained from the start address $TAD_1$, as indicated conceptually by a line $l_1$ in FIG. 14.

Figure 15:
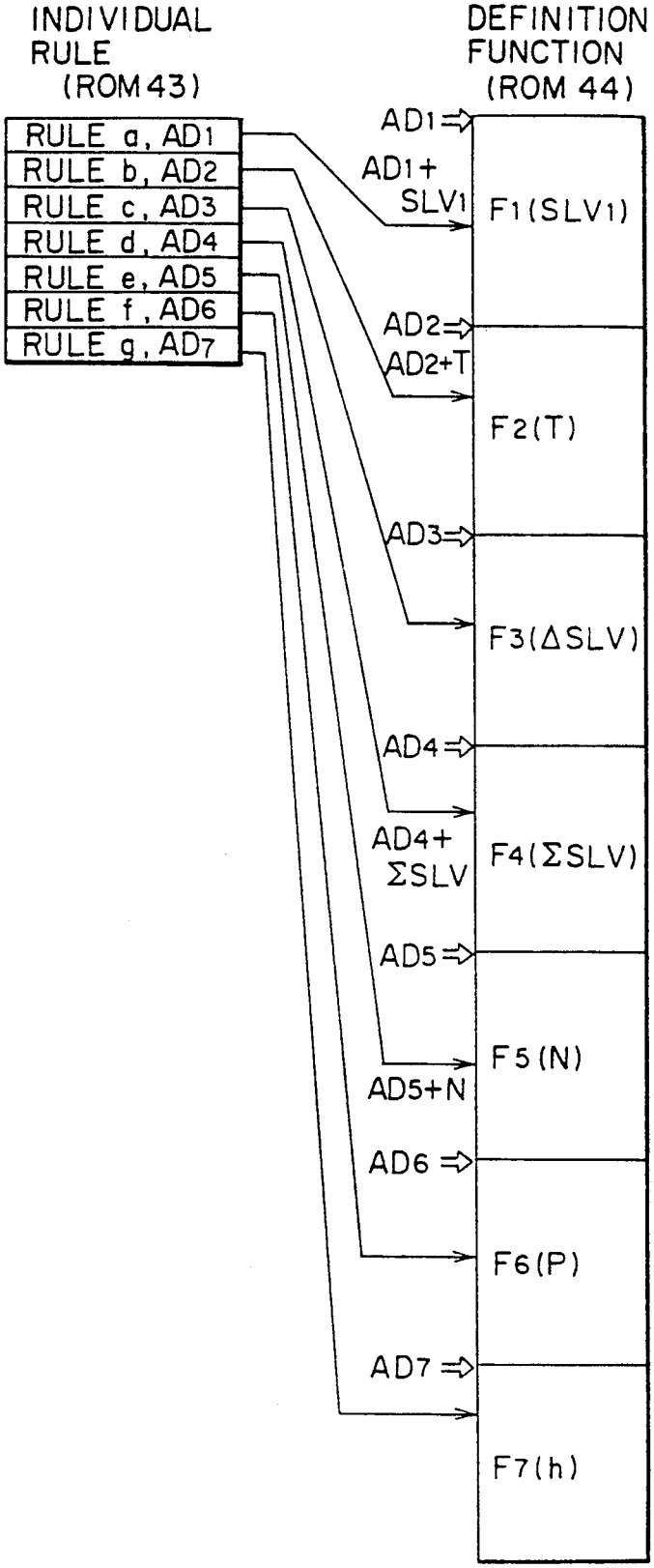
FIG. 15 is a conceptual diagram for illustrating relations between an individual rule storage area ROM43 and a definition function storage area ROM44.

At the same time, the start address KAD of the individual or knowledge rule storage area ROM43 is also read (step 930). A manner in which the knowledge rules or individual rules stored in the storage area ROM43 is illustrated in FIG. 15. It will be seen that the addresses $AD_1$ to $AD_7$ of the storage area ROM44 for the definition function to be used in the rules are stored in the order of the rules a to g.

In order to perform the signal processing operations sequentially for the rules a to g, a variable r representing the turns of the rules a to g in the sequential order thereof is first set to 0 (zero) (step 932). As first, upon processing for the rule a, it is possible to determine the address of the storage area ROM43 at which the knowledge rule a is placed by adding the variable r (=0) to the start address KAD of the storage area ROM43, i.e. from KAD+r=KAD, whereby the start address $AD_1$ of the area in the storage area ROM44 where the definition function shown in FIG. 11 at (a) to be used in the rule a is stored can be determined from the content placed at the address KAD (step 934).

Next, the value of the input data to be used in the rule a, i.e. the latest sensor lever $SLV_n$ stored in the storage area RAM41 at the step 914, is added to the start address $AD_1$ to fetch the content of the address $AD_1 + SLV_n$ of the area where the definition function shown in FIG. 11(*a*) is stored (step 936). The content of the address $AD_1+SLV_n$ of this area corresponds to the definition function for the sensor level $SLV_n$, i.e. the fire likelihood ratio $F_1(SLV_n)$.

Subsequently, the start address $TAD_1$ of the weight rule table A read out at the step 928 is similarly added with the variable r (=0), and the weighting value $\omega 11$ for the rule a is read out from the area of the storage area ROM45 designated by the address of $TAD_1+r=TAD_1$ to be written in the work area RAM47, while the weighting value $\omega 11$ is stored in the storage area RAM45 for determining the sum of the weighting values (step 938). Next, a product of the previously determined definition function value $F_1(SLV_n)$ and the weighting value $\omega 11$ is determined as $\omega 11 \cdot F_1(SLV_n)$ to be subsequently stored in the sum value storage area RAM46 (step 940).

Thereafter, the variable r is incremented by 1 (one) (step 942) to r=1, whereon the similar processing is performed for the rule b.

More specifically, also in the case of the processing for the rule b, the start address KAD of the storage area ROM43 is added with the variable r (=1). From KAD+r=KAD+1, there can be determined the address of the storage area ROM43 where the rule b is placed. On the basis of the content at the address KAD+1, there can be determined the start address $AD_2$ of the storage area ROM44 where the definition function shown in FIG. 11(*b*) to be used in the rule b (step 934) is stored.

Next, the value of the input data for the rule b, i.e. the time lapse T from the time point the sensor level exceeded the predetermined level $LV_1$ (as determined at the step 912) is added to the start address $AD_2$. Thus, the fire likelihood ratio $F_2(T)$ at the address $AD_2+T$ of the area where the definition function shown in FIG. 11(*b*) is stored can be obtained (step 936).

Subsequently, the start address $TAD_1$ of the weight rule table A read out at the step 928 is added with the variable r (=1), whereon the weighting value $\omega 21$ of the rule designated by the address $TAD_1+r=TAD_1+1$ to be subsequently written in the work area RAM47. At the same time, the weighting value $\omega 21$ is added to the weighting value $\omega 11$ stored previously in the storage area RAM45, whereby the content of the storage area RAM45 is updated to the sum value of $\omega 11+\omega 21$ (step 938). In this manner, in the RAM45, the weighting value $\omega 11$ to $\omega 71$ are sequentially added for every processing of the individual rules a to g at the step RAM45.

Next, a product $\omega 21 \cdot F_2(T)$ of the previously determined definition function value $F_2(T)$ and the weighting value $\omega 21$ is determined, whereon the resulting product is added to the product $\omega 11 \cdot F_1(SLV_n)$ stored previously in the storage area RAM46. Thus, the content of the sum value storage area RAM46 is updated to the resulting sum value $\omega 11 \cdot F_1(SLV_n)+\omega 21 \cdot F_2(T)$ (step 940). In this manner, in the storage area RAM46, the products $\omega 11 \cdot F_1(SLV_n)$ to $\omega 71 \cdot F_7(P)$ are added sequentially upon every processing of the rules a to g at the step 940.

Similar processing is performed for the rules c to g as well, whereby the fire likelihood ratios $F_3(\Delta SLV)$, $F_4(\Sigma SLV)$, $F_5(n)$, $F_6(p)$ and $F_7(h)$ are determined on the basis of the difference value $\Delta SLV$, the integral value $\Sigma SLV$, the ventilation frequency n, the occupant count number p and the danger degree h at the steps 916, 918, 924, 926 and 923. These fire likelihood ratios, namely the definition function values are multiplied by the weighting values $\omega 31$ to $\omega 71$, respectively, which are contained in the weight value table A stored in the storage area ROM45. Thus, finally stored in the storage area RAM46 is:

$$(RAM46) = \sum_{i=1}^{7} \omega 1 \cdot F \qquad \text{(Eq. 1)}$$

Further, stored in the storage area RAM45 is:

$$(RAM45) = \sum_{i=1}^{7} \omega 1 \qquad \text{(Eq. 2)}$$

Upon completion of the processing for all the rules a to g ("Y" at a step 944), the sum value (RAM46) of the products of the fire likelihood ratios and the weighting values given by the abovementioned expression Eq. 1 and stored in the storage area RAM46 is divided by the sum value (RAM45) of the weighting values given by the abovementioned expression Eq. 2 and stored in the storage area RAM45 (step 946), whereon the value "Total" resulting from the division is displayed on the display unit DP3 (step 952) and at the same time compared with a reference for the fire likelihood ratio. When the former exceeds the reference value ("Y" at a step 948), appropriate anti-fire measures such as fire indication are taken (step 950).

Thus, the signal processing operation for the first fire detector $DE_1$ comes to an end. Subsequently, a similar processing operation is repeated for the second fire detector $DE_2$ et seq. by selecting the appropriate weight controlling rules stored in the weight rule selection controlling rule storage area on the basis of the collected data.

In the above description, it has been assumed that the weight controlling rules 1 to 4, the processing rules a to g and the definition functions shown in FIG. 11 at (a) to (g) are employed. It should however be understood that they are only for the purpose of illustration or exemplification and may be increased or decreased or altered in respect to the contents in consideration of the environmental conditions in which the fire alarm system according to the instant embodiment is operated.

According to the instant embodiment of the invention in which the functions for the fire information are defined for every piece of data obtained by the data acquiring means with the plurality of rules for the processings performed by using the functions also being defined, the data obtained by the data acquisition means are processed in accordance with the processing rules on the basis of the corresponding functions, and in which the weights are imparted to the processing rules depending on the environmental conditions, it is possible to obtain the fire information with a further enhanced efficiency by imparting a weight of greater significance to the move valid rules appropriate to the given environmental conditions. Besides, for those rules in which the same function is employed, it is sufficient to impart the weight to only one rule. Thus, the number of rules can be decreased, and this is another advantage.

I claim:

1. A fire alarm system comprising:

detecting means for detecting at least one fire related condition of a detected area;

data generating means, coupled to said detecting means, for generating data denoting plural fire related phenomena based on the at least one fire related condition;

function memory means for storing data denoting plural likelihood ratio functions respectively associated with the plural fire related phenomena, each of the plural likelihood ratio functions defining a relation between a value of a fire likelihood ratio and a value of a respective fire related phenomenon, the fire likelihood ratio defining a relative probability of a fire attributable to the value of the respective fire related phenomenon;

processing rule memory means for storing plural processing rules, each of the processing rules designating at least one of the plural likelihood ratio functions and defining a processing to be performed by using the at least one designated likelihood ratio function to obtain one value of the fire likelihood ratio;

processing means, coupled to said data generating means and said function memory means and said processing rule memory means, for using the plural processing rules stored in said processing rule memory means to obtain corresponding plural likelihood ratio values, for determining a centroid value of the thus obtained plural likelihood ratio values, and for discriminating the presence of a fire based on the thus determined centroid value.

2. A fire alarm system as recited in claim 1, wherein said at least one fire related condition includes at least one of a temperature level, a smoke density and a gas concentration.

3. A fire alarm system as recited in claim 2, wherein said data generating means is further for generating data denoting at least one non-fire related environmental condition of the detected area;

wherein said function memory means is further for storing additional likelihood ratio functions respectively associated with the at least one non-fire related environmental condition; and, wherein at least one of said processing rules stored in said processing rule memory means is further for designating at least one of the additional likelihood ratio functions respectively associated with the at least one non-fire related environmental condition.

4. A fire alarm system as recited in claim 1, wherein one of the plural fire related phenomena is a rate of change with respect to time of a fire related condition detected by said detecting means.

5. A fire alarm system as recited in claim 1, wherein said function memory means and said processing rule memory means are rewriteable or replaceable to adapt to installation conditions in the detected area.

6. A fire alarm system as recited in claim 1, further comprising a fire detector unit and a receiver unit located apart from each other and coupled to each other via a signal line, said fire detector unit housing said detecting means, said receiver unit housing said data generating means, said function memory means, said processing rule memory means and said processing means.

7. A fire alarm system as recited in claim 1, further comprising a fire detector unit and a receiver unit located apart from each other and coupled to each other via a signal line, said fire detector unit housing said detecting means, said data generating means, said function memory means, said processing rule memory means and said processing means.

8. A fire alarm system as recited in claim 6 or 7, further comprising display means provided at said receiver unit for displaying the centroid value determined by said processing means.

9. A fire alarm system comprising:

detecting means for detecting at least one fire related condition of a detected area;

data generating means, coupled to said detecting means, for generating data denoting plural fire related phenomena based on the at least one fire related condition;

function memory means for storing data denoting plural likelihood ratio functions respectively associated with the plural fire related phenomena, each of the plural likelihood ratio functions defining a relation between a value of a fire likelihood ratio and a value of a respective fire related phenomenon, the fire likelihood ratio defining a relative probability of a fire attributable to the value of the respective fire related phenomenon;

processing rule memory means for storing plural processing rules, each of the processing rules designating at least one of the plural likelihood ratio functions and defining a processing to be performed by using the at least one designated likelihood ratio function to obtain one value of the fire likelihood ratio;

selection control means for selecting at least one of the plural processing rules stored in said processing rule memory means in accordance with at least one non-fire related environmental condition in the detected area;

processing means, coupled to said data generating means and said function memory means and said processing rule memory means and selection control means, for using the at least one selected processing rule selected by said selection control means to obtain at least one corresponding likelihood ratio value, for determining a centroid value of the thus obtained at least one likelihood ratio value, and for discriminating the presence of a fire based on the thus determined centroid value.

10. A fire system as recited in claim 9, wherein said function memory means and said processing rule memory means are rewriteable or replaceable to adapt to installation conditions in the detected area.

11. A fire alarm system as recited in claim 9 or 10, further comprising a fire detector unit and a receiver unit located apart from each other and coupled to each other via a signal line, said fire detector unit housing said detecting means, said receiver unit housing said data generating means, said function memory means, said processing means, said processing rule memory means and said selection control means.

12. A fire alarm system as recited in claim 9 or 10, further comprising a fire detector unit and a receiver unit located apart from each other and coupled to each other via a signal line, said fire detector unit housing said detecting means, said data generating means, said function memory means, said processing means, said processing rule memory means and said selection control means.

13. A fire alarm system as recited in claim 11, further comprising display means provided at said receiver unit for displaying the centroid value determined by said processing means.

14. A fire alarm system comprising:

detecting means for detecting at least one fire related condition of a detected area;

data generating means, coupled to said detecting means, for generating data denoting plural fire related phenomena based on the at least one fire related condition;

function memory means for storing data denoting plural likelihood ratio functions respectively associated with the plural fire related phenomena, each of the plural likelihood ratio functions defining a relation between a value of a fire likelihood ratio and a value of a respective fire related phenomenon, the fire likelihood ratio defining a relative probability of a fire attributable to the value of the respective fire related phenomenon;

processing rule memory means for storing plural processing rules, each of the processing rules designating at least one of the plural likelihood ratio functions and defining a processing to be performed by using the at least one designated likelihood ratio function to obtain one value of the fire likelihood ratio;

weighting control means for imparting a weighting coefficient to each of the plural processing rules stored in said processing rule memory means in accordance with at least one non-fire related environmental condition in the detected area;

processing means, coupled to said data generating means and said function memory means and said processing rule memory means and weighting control means, for using the plural processing rules having weighting coefficients imparted thereto by said weighting control means to obtain corresponding plural likelihood ratio values, for determining a centroid value of the thus obtained plural likelihood ratio values, and for discriminating the presence of a fire based on the thus determined centroid value.

15. A fire alarm system as recited in claim 14, wherein said function memory means and said processing rule memory means are rewriteable or replaceable to adapt to installation conditions in the detected area.

16. A fire alarm system as recited in claim 14 or 15, further comprising a fire detector unit and a receiver unit located apart from each other and coupled to each other via a signal line, said fire detector unit housing said detecting means, said receiver unit housing said data generating means, said function memory means, said processing means, said processing rule memory means and said weighting control means.

17. A fire alarm system as recited in claim 14 or 15, further comprising a fire detector unit and a receiver unit located apart from each other and coupled to each other via a signal line, said fire detector unit housing said detecting means, said data generating means, said function memory means, said processing means, said processing rule memory means and said weighting control means.

18. A fire alarm system as recited in claim 16, further comprising display means provided at said receiver unit for displaying the centroid value determined by said processing means.

* * * * *